US007987527B1

(12) United States Patent
Shumaker

(10) Patent No.: US 7,987,527 B1
(45) Date of Patent: Aug. 2, 2011

(54) TOILET VENTILATION DEVICE

(76) Inventor: James J. Shumaker, Swartz Creek, MI (US)

( * ) Notice: Subject to any disclaimer, the term of this patent is extended or adjusted under 35 U.S.C. 154(b) by 510 days.

(21) Appl. No.: 11/304,161

(22) Filed: Dec. 14, 2005

Related U.S. Application Data

(60) Provisional application No. 60/635,922, filed on Dec. 14, 2004.

(51) Int. Cl.
*E03D 9/04* (2006.01)

(52) U.S. Cl. ..... 4/213

(58) Field of Classification Search ..... 4/213, 209 R
See application file for complete search history.

(56) References Cited

U.S. PATENT DOCUMENTS 3,278,115 A * 10/1966 White et al. ..... 415/204
3,534,415 A * 10/1970 Huffman ..... 4/213
3,938,201 A 2/1976 McGrew
4,017,916 A 4/1977 Pearson
4,059,857 A 11/1977 Poister
4,063,315 A 12/1977 Carolan
4,085,470 A 4/1978 Roberts
4,094,023 A * 6/1978 Smith ..... 4/213
4,099,047 A 7/1978 Kirkland, Jr.
4,159,550 A 7/1979 Tobin, Jr.
4,168,548 A 9/1979 Cantrell
4,251,888 A 2/1981 Turner
4,317,242 A * 3/1982 Stamper ..... 4/213
4,318,192 A 3/1982 Williams
4,320,756 A 3/1982 Holmes
4,365,361 A 12/1982 Sanstrom
4,375,704 A * 3/1983 Smith ..... 4/213
4,433,443 A 2/1984 DeGraw
4,442,555 A 4/1984 Aoyama
4,512,241 A 4/1985 Morris
4,521,925 A 6/1985 Chen
4,523,870 A 6/1985 Spector
4,583,250 A 4/1986 Valarao
D290,037 S 5/1987 Todd, Jr.
4,701,966 A 10/1987 Schafer
4,820,140 A * 4/1989 Bishop ..... 418/152
4,876,748 A 10/1989 Chun
4,926,505 A 5/1990 Higuchi
4,933,996 A 6/1990 Sowards
5,029,346 A 7/1991 Fernald, Sr.
5,193,227 A 3/1993 Crowley, Jr.
5,245,711 A 9/1993 Oldfelt
5,276,595 A * 1/1994 Patrie ..... 362/101
5,353,443 A 10/1994 Sim
5,386,594 A 2/1995 Hilton (Continued)

*Primary Examiner* — Huyen Le
(74) *Attorney, Agent, or Firm* — Flint Patent Service; Jack E. Tubbs

(57) ABSTRACT

One embodiment of a device for transporting odor-containing air from a region including an interior airspace of a toilet bowl to a drain line that connects a water seal-type drain of the toilet bowl to a septic system comprises: an exhaust tube having an inlet and an outlet, wherein the inlet is in fluid communication with the region, the water seal-type drain having a drain ceiling at least partly below the normal standing water level of the toilet bowl, wherein the outlet is substantially between the surface of the water seal and the portion of the drain ceiling furthest below the normal standing water level of the toilet bowl.

Another embodiment of such a device comprises: an air pump assembly having an air intake and an air exhaust, wherein the air intake is in fluid communication with the region, an exhaust tube assembly including an inlet, and a connecting channel, wherein the connecting channel is in fluid communication with the air exhaust and the inlet.

20 Claims, 13 Drawing Sheets

U.S. PATENT DOCUMENTS 5,426,794 A 6/1995 Hennessy
5,454,122 A 10/1995 Bergeron
5,488,741 A 2/1996 Hunnicutt, Jr.
5,519,899 A 5/1996 Taylor
5,555,572 A 9/1996 Hunnicutt, Jr.
5,570,477 A * 11/1996 Rodriguez ..... 4/213
5,590,423 A 1/1997 Boykin
5,652,969 A 8/1997 Taylor
5,704,074 A 1/1998 Baldea
5,715,543 A 2/1998 Sim
5,718,005 A 2/1998 Ng
D398,049 S 9/1998 Willis
D402,747 S 12/1998 Yeatts, Jr.
5,875,496 A 3/1999 Schaffer
5,875,497 A 3/1999 Lovejoy
5,894,001 A 4/1999 Hitzler
5,898,951 A * 5/1999 Rakoz ..... 4/217
5,958,334 A 9/1999 Haddon
5,991,934 A 11/1999 Hsu
5,996,131 A 12/1999 Vallair
6,016,576 A 1/2000 Happe
6,019,862 A 2/2000 Cardwell
6,052,837 A 4/2000 Norton
6,073,273 A 6/2000 Tillen
6,073,275 A 6/2000 Klopocinski
6,088,845 A 7/2000 Estrada
6,158,058 A 12/2000 Martens
6,167,576 B1 1/2001 Sollami
6,209,146 B1 4/2001 Gonzalez
6,219,853 B1 4/2001 Johnson
6,223,357 B1 5/2001 Claas
6,237,163 B1 5/2001 Guzzo
6,260,214 B1 7/2001 Smith
6,279,173 B1 8/2001 Denzin
6,295,656 B1 10/2001 Tillen
6,298,500 B1 10/2001 Sollami
6,308,731 B1 10/2001 Kawasaki
6,360,377 B2 3/2002 Sollami
6,363,542 B1 4/2002 Pope, Sr.
6,370,702 B1 4/2002 Iddings, Sr.
6,370,703 B1 4/2002 Kim
6,374,431 B1 4/2002 Dahlberg
6,376,442 B1 4/2002 Perthuisot
6,385,789 B1 5/2002 Pondelick
6,393,343 B1 5/2002 Frey
6,415,816 B1 7/2002 Beckey
6,425,530 B1 7/2002 Coakley
D461,547 S 8/2002 Christian, Sr.
6,434,759 B1 8/2002 Pondelick
6,450,196 B1 9/2002 Bartos
6,457,186 B1 10/2002 Stewart
6,463,595 B2 10/2002 Prisco
6,467,101 B1 10/2002 Artola
6,474,357 B2 11/2002 Naski
6,496,986 B1 12/2002 Lumsden
6,499,150 B1 12/2002 Thompson
6,499,151 B1 12/2002 Ollinger
6,513,174 B1 2/2003 Johansson
6,584,620 B1 7/2003 Reutov

* cited by examiner

Electrical Schematic for Circuit Board and all other Components

TOILET VENTILATION DEVICE

CROSS-REFERENCE TO RELATED APPLICATION

This utility patent application is based on and claims priority to U.S. Provisional Patent Application No. 60/635,922 filed on Dec. 14, 2004. Provisional Patent Application No. 60/635,922 is incorporated herein by reference in its entirety.

TECHNICAL FIELD

This invention relates to devices for transporting odor-containing air from the region in and around a toilet bowl into a septic system.

BACKGROUND OF THE INVENTION

Known devices for toilet ventilation suffer from the disadvantages and costs of having air conduits that are routed outside the toilet bowl and plumbed into the septic line intrusively, or otherwise require substantial modifications to the design of a conventional toilet. Still other devices have separate air manifolds that fit underneath the toilet, which are costly and require significant effort to install. Also, mechanical or pneumatic valves are frequently used with known devices to prevent the backflow of septic odors into the toilet bowl. The present invention provides a ventilation device which is readily adaptable to an existing toilet. Furthermore, some of the distinct benefits of the invention can be realized by "original equipment manufacturer" (OEM) toilets that incorporate the invention, as-purchased. Furthermore, a valve to control the backflow of septic odors is not required.

SUMMARY OF THE INVENTION

One embodiment of a device for transporting odor-containing air from a region including an interior airspace of a toilet bowl to a drain line that connects a water seal-type drain of the toilet bowl to a septic system comprises: an exhaust tube having an inlet and an outlet, wherein the inlet is in fluid communication with the region, the water seal-type drain having a drain ceiling at least partly below the normal standing water level of the toilet bowl, wherein the outlet is substantially between the surface of the water seal and the portion of the drain ceiling furthest below the normal standing water level of the toilet bowl.

Another embodiment of such a device comprises: an air pump assembly having an air intake and an air exhaust, wherein the air intake is in fluid communication with the region, an exhaust tube assembly including an inlet, and a connecting channel, wherein the connecting channel is in fluid communication with the air exhaust and the inlet.

DESCRIPTION OF THE PREFERRED EMBODIMENT

Figure 1:
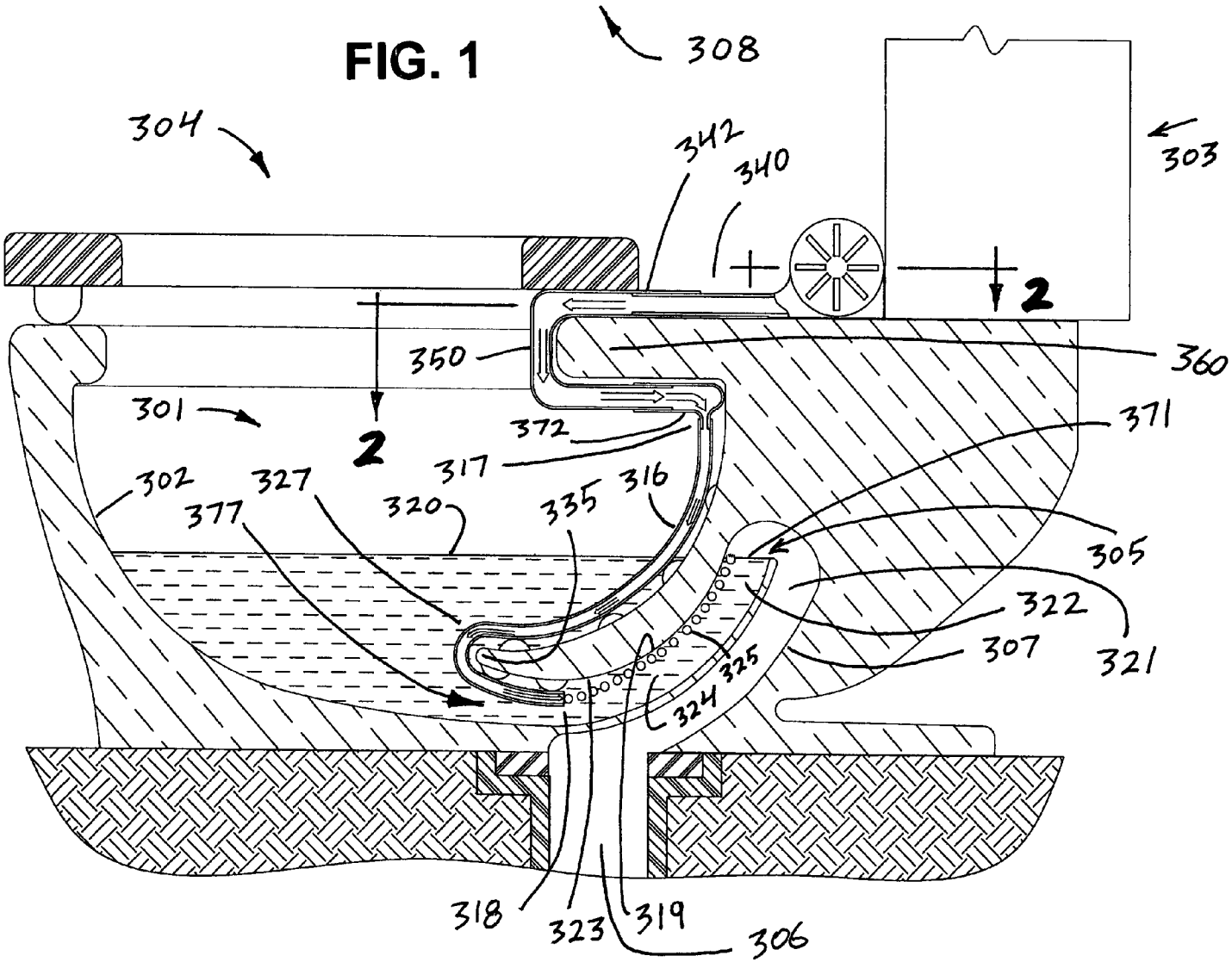
FIG. 1 is a partly-sectional side view of the present invention as-installed for a toilet.
Figure 2:
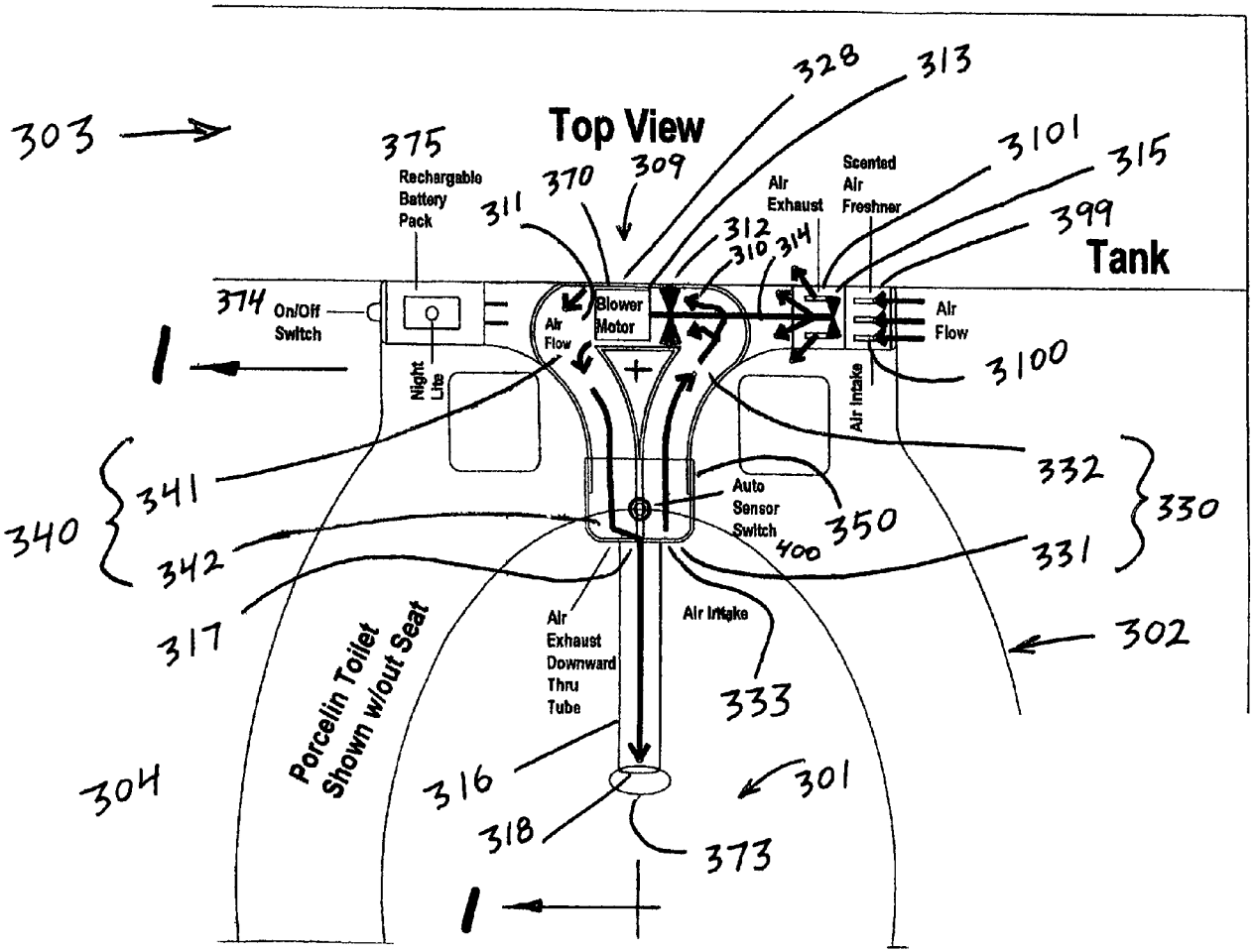
FIG. 2 is a partly-sectional top view of the present invention as-installed for a toilet.

Referring first to FIGS. 1-2, the invention includes various devices for transporting odor-containing air from a region including an interior airspace of a is toilet bowl to a drain line that connects a water seal-type drain of the toilet bowl to a septic system. The odor-containing air results from use of a toilet by a person. The region (not shown) which the invention is intended to affect includes the interior airspace 301 of the bowl 302 of the toilet 303, but can also include the airspace generally surrounding the toilet 304. A typical toilet has a water seal-type drain 305 upstream from the toilet outlet 306. ("Upstream" describes a relative location for one aspect of a toilet's plumbing system which is further away, in terms of the fluid path, from the septic system than another aspect.) Another name for a water seal-type drain is a "water trap." One purpose of this water seal-type drain (or "drain") is to prevent odor-containing air from a septic system (not shown) in fluid communication with toilet outlet 306 and drain line 307 from being transferred into the air 308 of the room where the toilet is located.

The invention includes a fan assembly 309 having an air intake 310 and an air exhaust 311. The fan assembly is typically a fan 312 driven by an electric motor 313. The fan can be of the propeller-type having individual vanes or blades which are arranged radially about a fan hub (not shown) for displacing air in a desired direction. Numerous other fan, blower and air pump designs are also adaptable for use with the invention including centrifugal flow (a.k.a. squirrel cage) fans, rotary fans, axial flow (tube axial, or vane axial with air straightening vanes added either in front or behind the blades), mixed axial and centrifugal flow, cross flow, and positive displacement vane pumps in various vane configurations including sliding vane, flexible vane, swinging vane, rolling vane and external vane, etc. The source of power to operate the fan can be electric motor ("motor") 313. Motor 313 may have a drive shaft 314 that extends outwardly from motor body 370 of the motor so that the fan can be attached to the drive shaft. Furthermore, the drive shaft may be extended in one direction (or the other direction) to facilitate attachment and operation of an auxiliary fan 315, as described further below. (Connecting a fan and/or auxiliary fan to the motor can also be accomplished using intermediate members such as linkages, shafts, drive belts, gears, etc. (not shown)). Or the drive shaft may extend out from motor body 370 in two directions, to facilitate connecting the fan to one side of the motor and the auxiliary fan to the other side of the motor. Furthermore, there may be no distinctly visible drive shaft, as the electric motor may be of the type having fan blades or vanes provided as an integral part of the rotor (not shown) of the electric motor. Also, fan 312 and auxiliary fan 315 can be driven by separate motor units (i.e. two individual motors).

Fan assembly 309 has an air intake 3100 for drawing air from a desired location, such as the region described above. This air intake may be a part of a housing 328 for the fan assembly, or it may simply be the side of the fan where air is to drawn from. The fan assembly also has an air exhaust 3101. The air intake and air exhaust are in fluid communication with each other, meaning that a fluid (in this case, air) is able to pass between the air intake and air exhaust during operation of the fan assembly. The air exhaust is also in fluid communication with the region, via the air intake. The structure for achieving this fluid communication between the air exhaust and the region is described in greater detail below, and in the attached figures.

The invention further includes an exhaust tube 316 having an inlet 317 and outlet 318. The inlet is in fluid communication with the air exhaust 311. As a result, when the motor is operated, air is transported successively from the region to the air intake, air exhaust and inlet 317 of exhaust tube 316.

The water seal-type drain has a drain ceiling 319 at least partly below the normal water level 320 of the toilet bowl. Because drain ceiling 319 is at least partly below the normal standing water level 320, odor-containing air 321 from the septic system is substantially prevented from entering the air of the room via the interior airspace 301. Outlet 318 of exhaust tube 316 can be substantially between surface 371 of water seal 322 and portion 323 of drain ceiling 319 located furthest below the normal standing water level 320 of the toilet bowl. Alternatively, using a longer exhaust tube 316, outlet 318 can be located downstream from surface 371 of water seal 322. ("Downstream" describes a to relative location for one aspect of a toilet's plumbing system which is closer, in terms of the fluid path, to the septic system than another aspect.) If this is done, a one-way check valve or flapper valve (not shown) may optionally be added at outlet 318 to prevent odor-containing air from the septic system from being transferred or communicated back into the air 308 of the room. As described is further below, the outlet of the exhaust tube can also optionally be below the portion of the drain ceiling furthest below the normal standing water level of the toilet bowl, as shown in FIG. 1.

During operation of the electric motor, odor-containing air is drawn by the fan assembly from the region into the air intake, exits the exhaust tube at the outlet, is transported through water 324 in drain 305 in the form of air bubbles 325, which rise due to their inherent buoyancy to surface 371 of water seal 322. Here the air bubbles tend to burst, which disperses the air which originates from the region into the air in the drain line.

In one embodiment, the unit comprising the blower assembly, air pump, or electric motor and fan (together with the electric power source) is capable of producing an airflow through the outlet of about 3 to about 6 cubic feet per minute (CFM) at normal elevations and room temperatures. Alternatively, the unit is capable of producing an airflow through the outlet of about 2 to about 8 CFM at normal elevations and room temperatures. Alternatively, the unit is capable of producing an airflow through the outlet of about 1 to about 10 CFM at normal elevations and room temperatures. These airflow rates will produce the desired evacuation of odor-containing air from the region. The unit is also capable of simultaneously producing an air pressure at the outlet of about 0.29 to about 0.5 pound per square inch (PSI) at normal elevations and room temperatures. Alternatively, the unit is capable of simultaneously producing an air pressure at the outlet of about 0.20 to about 0.7 PSI at normal elevations and room temperatures. Alternatively, the unit is capable of simultaneously producing an air pressure at the outlet of about 0.10 to about 10.0 PSI at normal elevations and room temperatures. These air pressures developed are sufficient to overcome the "head pressure" exerted by the water standing in the drain, so that the odor-containing air will be transported as air bubbles from the outlet into the water in the drain. Note that the airflow rates and air pressures above are provided as guidelines, and may need to be limited so as to prevent undesired effects. These undesired effects may include "gurgling" noises within the drain due to the formation and bursting of air bubbles, and/or the splashing of water from the drain into the drain line (which can lower the normal standing water level in the toilet bowl below portion 323, thus rendering the water seal ineffective against backflow of air from the septic tank).

In some embodiments of the invention, exhaust tube 316 is substantially within toilet bowl 302. Exhaust tube 316 can be a separate component from the toilet, so that it is adaptable for installation in, and use with, a toilet that does not have such an apparatus. The exhaust tube can be formed from a material that is substantially flexible such as, for example, a flexible polymer, plastic, rubber, silicone, nylon or other polymer. Alternatively, a substantially inflexible material can be used for an exhaust tube having a geometry which is adaptable to a relatively large number of toilets. Use of a flexible material can make it easier to is install the exhaust tube in the toilet, and also to properly locate outlet 18 within the drain (as described above). A shape retaining member (not shown), such as a permanently deformable wire made of a low carbon steel, can be used in conjunction with the exhaust tube to aid in keeping the exhaust tube conformed to the desired shape, such as conforming it to the shape the shape of the interior of the toilet bowl. Alternatively, the shape retaining member can be a strip of metal flat stock, or any other material that causes the exhaust tube, after forming the exhaust tube into a predetermined shape, to substantially retain the predetermined shape, which typically is to locate the tube proximately with respect to the contour of an interior surface of the toilet bowl. Furthermore, the wall (not shown) of the exhaust tube, or the wall's inner or outer surfaces (not shown) can be reinforced with high carbon steel wire, nylon wire, nylon braid, or other reinforcing materials. In another embodiment, a coil spring inside the exhaust tube is used. This is similar to that of an engine coolant hose for an internal combustion engine, which is reinforced with a coiled steel wire to prevent the hose from collapsing and maintain proper fluid flow, despite relatively sharp bends in the hose.

Exhaust tube 316 can alternatively be made of a substantially rigid material. In this case, the exhaust tube can be prefabricated to a shape that substantially keeps the exhaust tube proximately located with respect to the contour of the interior surface for many toilet bowls. Alternatively, the exhaust tube can be substantially permanently deformable. For example, the exhaust tube can be is fabricated from a copper alloy or steel alloy, and of a suitably thin tube wall cross section, such that the predetermined shape can be obtained by hand forming the tube into the desired shape. It may also be desirable to provide an exhaust tube made of a material that can be successively hand formed, so that if the user is not satisfied with the shape initially obtained, the tube can be hand formed at least several times until the user is satisfied that the predetermined shape has been achieved. To further enhance the ability of the exhaust tube to be formed one or more times, the tube may be of a construction having convolutions or corrugations in its inner and/or outer surfaces. Obtaining a predetermined shape that substantially conforms to the toilet bowl is beneficial because the exhaust tube will then be less likely to interfere with use of the toilet by a person. For example, it will be less likely to cause undesired splash during urination when a person is standing, and less likely to become entangled with toilet paper that is flushed down the toilet.

It is desirable that the exhaust tube transport air effectively from air outlet conduit 340 to the drain 305 as described above. The exhaust tube can be a hollow pipe-like structure. The cross section of the tube can be of any suitable shape, to round or nonround. The nonround cross sections, by way of illustration, include those of an ellipse, oval, rectangle, rectangle having rounded corners, square, triangle, hexagon, etc. Furthermore, the cross section of the exhaust tube can be any combination of these cross sections. For example, the cross section of the exhaust tube can resemble an ellipse but have a "major axis" which follows an arc. If the cross section is round, the exhaust tube can have a diameter of about 0.375 inch to about 0.5 inches in diameter. Alternatively, if the cross section is round, the exhaust tube can have a diameter of about 0.375 inch to about 0.625 inches in diameter. Alternatively, if the cross section is round, the exhaust tube can have a diameter of about 0.375 inch to about 1.0 inches in diameter. Alternatively, if the cross section is round, the exhaust tube can have a diameter of about 0.25 inch to about 1.5 inches in diameter. Correspondingly, if the cross section is not round, the exhaust tube can have an area of about 0.05 square inches to about 1.8 square inches. Whereas the invention is described herein as having one exhaust tube (i.e. one airflow path into the drain), it also contemplates the use of a plurality of exhaust tubes to provide a plurality of airflow paths into the drain.

In another embodiment, the exhaust tube is adaptable for attachment to the interior surface of the toilet bowl. Attaching the tube can help keep it from shifting position within the toilet bowl and potentially blocking toilet bowl outlet 377 when toilet paper, etc., is flushed down the toilet. This can be accomplished by a number of schemes. For example, rubber suction cups attached to the exhaust tube can be used to attach the exhaust tube to the interior surface. In another embodiment, the exhaust tube has a curve 327 which is adaptable for snapping or wedging curve 327 into place over front lip 335 of drain ceiling 319. ("Snapping or wedging" may include employment of the friction between at least part of the exhaust tube and toilet bowl to substantially retain the exhaust tube is within the toilet bowl.) Furthermore, adhesive tape or adhesive cement adapted for use under water can also be used to attach the exhaust tube. Furthermore, a nylon, plastic, or wire feature (not shown) located toward the outlet can be used to rest or press on the drain so as to support the exhaust tube and keep it located near a wall (not shown) of the drain (or drain ceiling 319) and out of the way of toilet paper, etc. being flushed down the toilet. This feature can be connected to the exhaust tube by a snap fit attachment (not shown). Alternatively this feature can be implemented in a separate component that presses against and retains the exhaust tube. This feature can be a pair of substantially half circular- or half oval-shaped fingers (not shown) that substantially form a "C"-shape, which fingers serve to rest or press on a wall of the drain.

In another embodiment (not shown), the exhaust tube is not located substantially within the toilet bowl. For example, the exhaust tube may be located outside the toilet bowl, proximate to the outer surface of the toilet bowl, wherein the inlet is in fluid communication with the air exhaust of the fan assembly, and the outlet of the exhaust tube is connected (for fluid communication) from outside the toilet to the location substantially between the surface of the water seal 322 and the portion of the drain ceiling 323 furthest below the normal standing water level 320. As described above, the outlet of the exhaust tube may alternatively be connected (for fluid communication) from outside the toilet to a location downstream from the water seal, with a one-way check valve used optionally at the outlet. Another variation is to form the toilet ventilation device, or a is substantial portion thereof, into the toilet bowl and the lower portion (not shown) of the toilet below the water tank during the original ceramic casting and manufacturing of the toilet, so that fluid communication between the air exhaust of the fan assembly and drain (either upstream or downstream of surface 371 of water seal 322) is facilitated. If this done, the presence of the toilet ventilation device may or may not be readily observable by a user of the toilet.

In other embodiments (not shown), the fan assembly is located anywhere outside the toilet bowl, with the air inlet conduit and air outlet conduit/exhaust tube being modified (compared to those shown) as necessary to provide fluid (or fluid and sliding) communication between the various components. (Any components of the invention described as being "in sliding communication" with each other can also be described as being "in communication with and movable relative to" each other.) For example, the fan assembly can be located outside the toilet bowl at a side of the toilet bowl as a person faces the toilet, and towards the bottom of the toilet (or substantially behind the toilet), with the conduits running out to and back from the fan assembly as necessary to place an air inlet port in the region and the outlet of the exhaust tube in the drain. For this example the exhaust tube may not be substantially within the toilet bowl—more of the exhaust tube being outside of the toilet bowl than inside it. Note that the air inlet conduit, air outlet conduit, exhaust tube, and other componentry, can be integrated into fewer components or expanded into more components as desired to achieve various design objectives related to cost, simplicity, ease of installation by the user, etc.

Referring to FIG. 2, the fan assembly has a housing 328, wherein the drive shaft is at least partly within the housing. Accordingly, the drive shaft can be connected to a fan also located within the housing. Furthermore, the drive shaft can be partly outside the housing, so as to operate an auxiliary fan, as described further below. The housing can be fabricated so as to provide desired geometries for the air intake and air exhaust of the fan assembly. The housing may also be adaptable for attaching the fan assembly to other components of the toilet and toilet ventilation device. For example, air inlet conduit 330 having first and second inlet ends 331, 332 can be provided between the air intake and the region above the normal standing water level of the toilet bowl. During operation, the air inlet conduit serves to transfer air from the region to the fan assembly in the case where the fan assembly is located some distance from the region. First inlet end 331 has an air inlet port located approximately at 333. The air inlet port is in fluid communication with both the first inlet end and the region. Second inlet end 332 is in fluid communication with air intake 310. An air outlet conduit 40 having first and second outlet ends 341, 342, can be provided between the air exhaust and the exhaust tube. Air outlet conduit 340 serves to transfer air from the fan assembly to the exhaust tube when the fan assembly is located some distance from the exhaust tube. First outlet end 341 is in fluid communication with air exhaust 311. Second outlet end 342 is in fluid communication with inlet 317 of exhaust tube 316. The housing, air inlet and outlet conduits, and a number of other components can be made from various materials including injection-molded plastic, nylon, synthetic rubber and/or stainless steel sheet metal.

Referring to FIGS. 1-2, in another embodiment coupling 350 is in sliding and fluid communication with second outlet end 342 of air outlet conduit 340. Coupling 350 may also be in sliding and fluid communication with intermediate coupling 372 located between coupling 350 and the exhaust tube. Intermediate coupling 372 may be in fluid communication with the exhaust tube, or in sliding and fluid communication with it. The coupling is furthermore in fluid communication with inlet 317 of exhaust tube 316. The coupling is formed from a suitable material such as polymer, plastic, nylon, a rubber compound, etc. that is compatible for slidably attaching to air outlet conduit 340 and/or air inlet conduit 330 (the coupling may be used with either conduit or both conduits). The geometry of the coupling serves to accommodate the installation of the toilet ventilation device on the toilet, and specifically to accommodate proper location of the exhaust tube and air inlet port within the toilet bowl. By use of coupling 350, various upper toilet bowl geometries can be accommodated. Referring to FIG. 1, it will be seen that upper toilet bowl shelf 360 could vary in terms of how far shelf 360 extends into interior airspace 301. Unless coupling 350 (and, optionally, intermediate coupling 372) is employed in the toilet ventilation device, it will be necessary to carefully design the lengths of the air inlet conduit and air outlet conduit, to properly connect the air outlet conduit with the exhaust tube. Otherwise, the air outlet conduit may be too long, for example, and the air outlet tube and the exhaust tube may protrude into interior airspace 301 further than desired for reasons of appearance (and also function as described above regarding the proximate location of the exhaust tube with respect to the interior surface of the toilet bowl). Conversely, if the air outlet conduit is too short, it might be difficult to locate both the exhaust tube properly within the toilet bowl as well as the remaining components on top of upper toilet bowl shelf 360, in terms of attaching the remaining components to the toilet. In addition, if the air inlet conduit is too short, the placement of the air inlet port with respect to the region may not be optimal for transporting air from the region into the toilet ventilation device.

Referring to FIG. 2, in another embodiment coupling 350 is in sliding and fluid communication with first inlet end 331 of air inlet conduit 330, further wherein the air inlet port is located in coupling 350 approximately at 333. As stated above, by use of coupling 350, various upper toilet bowl geometries can be accommodated.

In another embodiment, the exhaust tube is adaptable for location proximately with respect to a rinse water outlet port of the toilet bowl. Referring to FIG. 1, at least a portion of coupling 350 or exhaust tube 316 is located substantially directly under a rinse water outlet port (not shown) located along the bottom surface (not shown) of upper toilet bowl shelf 360. In one embodiment the exhaust tube is fabricated from a material that can be hand formed into a predetermined shape by the user. During installation of the toilet ventilation device, the user can hand form the exhaust tube so that it is located proximately with respect to such a rinse water outlet port. Then the exhaust tube will be rinsed with water from the tank when the toilet is flushed. This will aid in keeping the exhaust tube, in similar fashion to the inner surface of the toilet bowl, clean by rinsing it with fresh water whenever the toilet is flushed.

Figure 6:
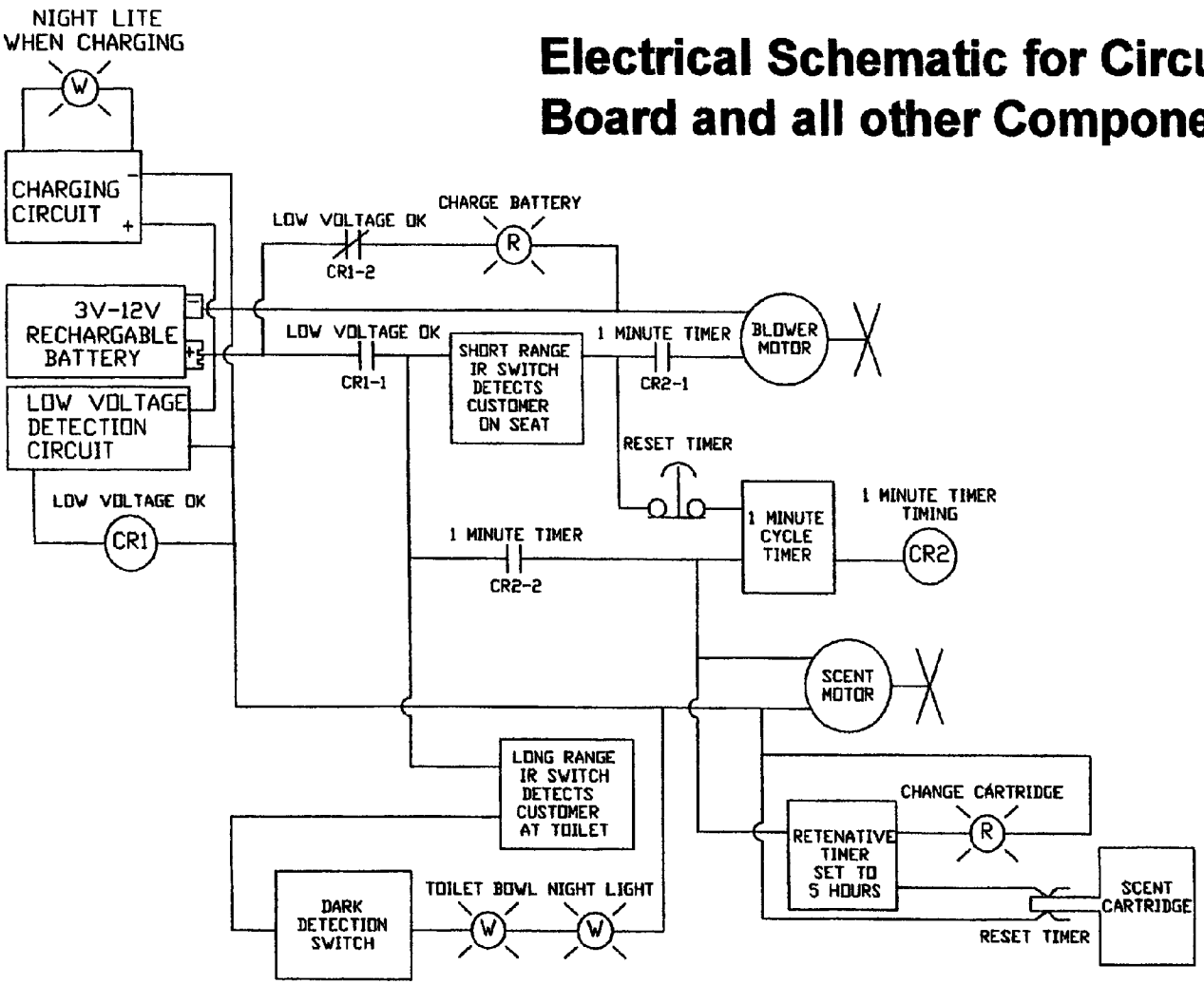
FIG. 6 is an electrical schematic diagram according to one embodiment of the present invention.

In another embodiment, an electric switch 374 is included to manually operate the electric motor according to the wishes of the user. This electric switch can be located at various places such as, for example, near the battery 375 as in FIG. 2. Furthermore, an electric switch can be employed to automatically operate the motor. FIG. 6 shows an electrical schematic diagram according to one embodiment of the toilet ventilation device. The motor may be operated solely in response to a contact switch such as a seat switch (not shown) closing the electric circuit in response to a predetermined condition. One example of such a predetermined condition is a person sitting on the toilet seat and displacing such a seat switch until it completes the electric circuit. Dual springs (not shown) can slightly bias the toilet seat to a position wherein the contact switch does not engage the electric motor when a person does not sit on the toilet seat. Furthermore, a plurality of electric switches can be used to manually operate the electric motor and/or automatically operate the electric motor in response to a predetermined condition or conditions. This may be the case in the situation where one or more switches are provided to control the automatic operation of is the toilet ventilation device when a person sits on the toilet seat, but the person decides to conserve the life of the battery by manually shutting off the electric motor. Accordingly, partial or complete control of the electric motor may be accomplished via a manual electric switch. Also, partial or complete control of the electric motor may be accomplished via an automatic electric switch, such as a contact switch that engages the electric motor when a person sits on the toilet seat. Furthermore, the automatic electric switch can be comprised of an adjustable motion sensor or other automatic sensor switch located, for example at 400 that engages the motor in response to a predetermined condition, such as sensing the presence of a person on the toilet seat, or lowering or raising the toilet seat or cover (i.e. lid). Furthermore, the various automatic and manual functions described above for separate switches can be combined into one or more switches that provide the same functionality. Furthermore, the switches that detect the predetermined condition(s) to begin operating the electric motor can comprise load or pressure sensors that are responsive to a person sitting on the toilet seat.

Figure 3:
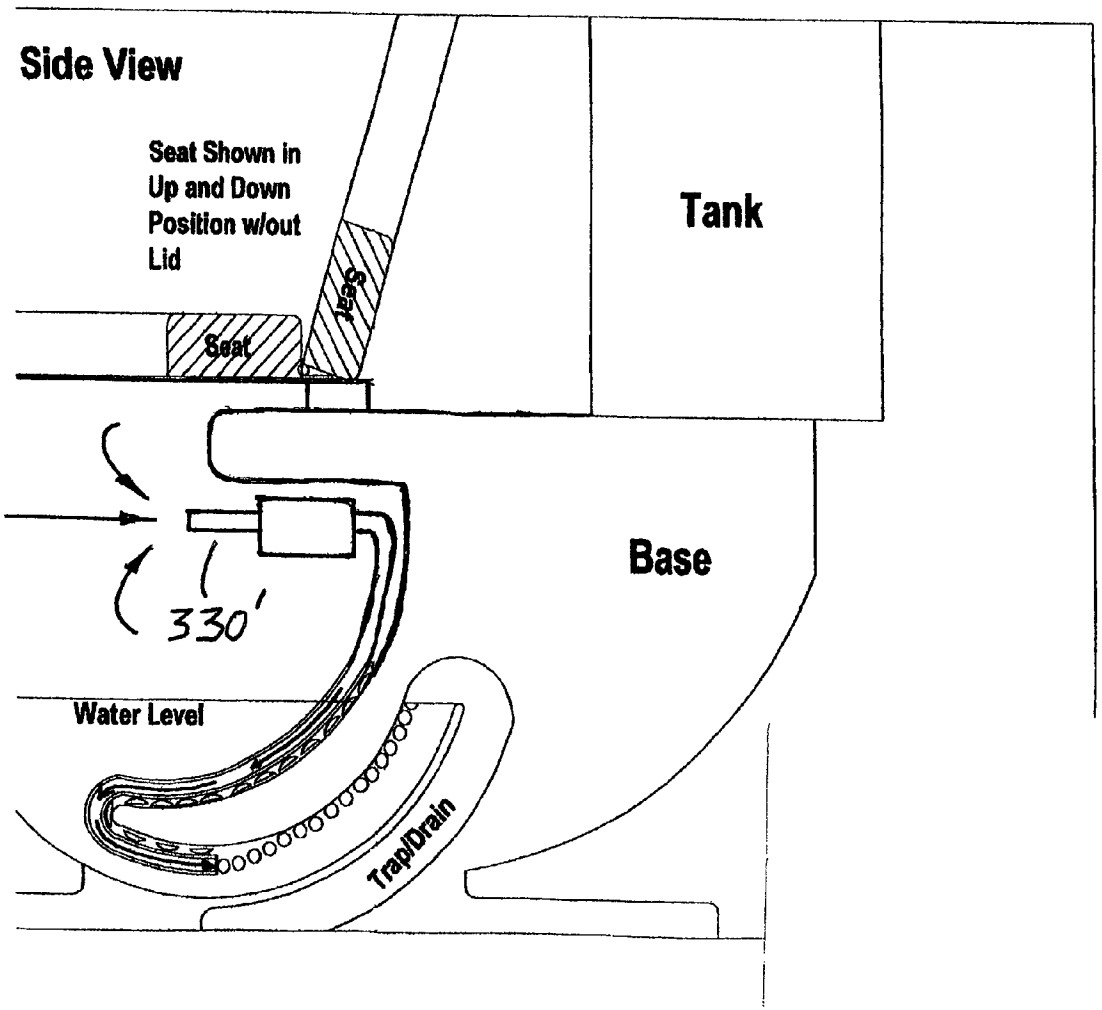
FIG. 3 is a partly-sectional side view of the present invention as-installed, according to another embodiment.
Figure 4:
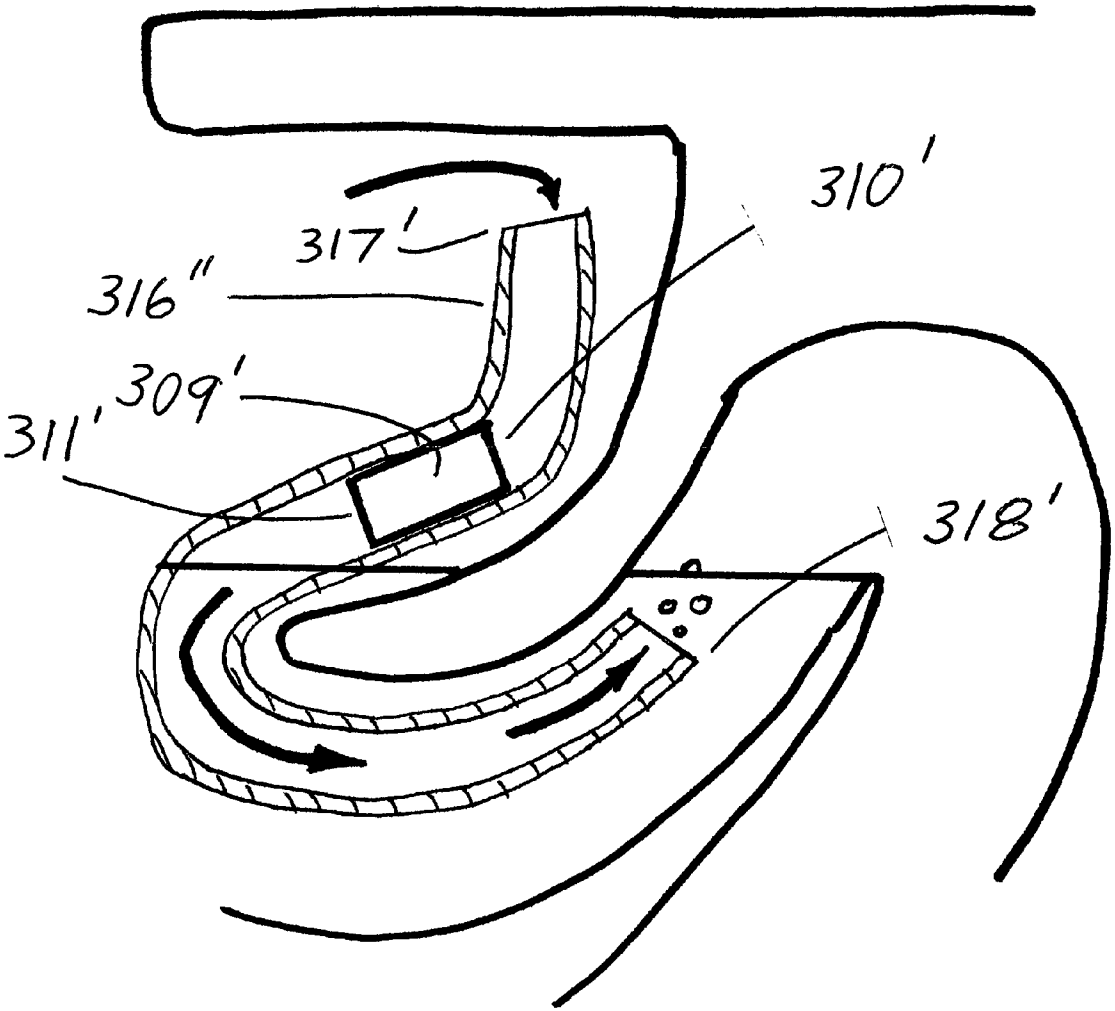
FIG. 4 is a partly-sectional side view of the present invention as-installed, according to yet another embodiment.

Both the exhaust tube and the fan assembly can be substantially within the toilet bowl. The fan assembly can be oriented in various ways within the toilet bowl. Referring to FIG. 3, the drive shaft of the electric motor of the fan assembly and air inlet conduit 330' are parallel to the surface of the water in the toilet bowl, and also parallel to a plane of symmetry that passes through the toilet and divides it into left and right halves as a person faces the toilet (this plane can also be described as a plane that bisects the toilet). In another embodiment, the drive shaft of the electric motor of the fan assembly and the air inlet conduit are perpendicular to the surface of the water. In another embodiment, the drive shaft and the air inlet conduit are again parallel to the surface of the water and perpendicular to the plane of symmetry described above. Referring to FIG. 4, another embodiment includes an exhaust tube 316" with an inlet 317' and an outlet 318', wherein the inlet is in fluid communication with the region. A fan assembly 309' has an air intake 310' and an air exhaust 311', wherein the air intake is in fluid communication with the inlet, further wherein the air exhaust is in fluid communication with the outlet. The fan assembly can be structurally as well as functionally in-line with the exhaust tube. The exhaust tube may be substantially made from a single piece of tubing, with the fan assembly contained inside the exhaust tube. Or the exhaust tube may be made of two sections of tubing—one attached to the air intake and another attached to the air exhaust, with the fan assembly interposed between the two sections. The inner diameter of inlet 317' can be substantially the same as the outer diameter of fan assembly (or air pump assembly) 309'. Alternatively, inlet 317' can have a substantially smaller diameter as compared to that of 309'. Alternatively, inlet 317' can have a substantially larger diameter as compared to that of 309'. Outlet 318' can also be of substantially of the same, smaller or larger diameter as compared to that of 309'. These variations in diameter can be used over part or substantially all of the length of the respective exhaust tubes (or tube). The controls for embodiments like those of FIGS. 3-4 may include remote control electronic circuitry, such as is know in the electronics arts for use with televisions, video recorders, DVD players, air conditioners and passive infrared (P.I.R.) devices. For such remote control electronic circuitry, there does not have to be a physical connection between the motor and the electronic device that controls the motor. For example, a separate transmitter unit may transmit a signal upon sensing a predetermined condition, such as a person sitting on the toilet seat. Upon receiving the transmitted signal via a corresponding signal receiving unit, the signal receiving unit causes the electric motor of the invention to operate. For embodiments like those of FIGS. 3-4, the batteries could be connected to the electric motor via electric wires that run from the motor inside the toilet bowl to another location having the battery. Alternatively, the battery can be in close proximity to the motor, so that the battery is also substantially within the toilet bowl. A shape retaining member (not shown) similar to the shape retaining member described above may be incorporated into the embodiments of FIG. 3-4. Such a shape retaining member can help maintain the desired shape for the exhaust tube, and can help keep the exhaust tube close to the inner surface of the toilet bowl.

The exhaust tube may additionally have a 90 degree or 180 degree inlet bend which makes intrusion of liquid into the inside of the exhaust tube from the bowl rinsing ports or urination by a person less likely. One or more baffle-like devices may also be included at inlet 317' to make intrusion of liquid into the inside of the exhaust tube less likely. Baffle-like devices can further be used with exhaust is tube 316" having other angles for the inlet bend or substantially no inlet bend.

Figure 5:
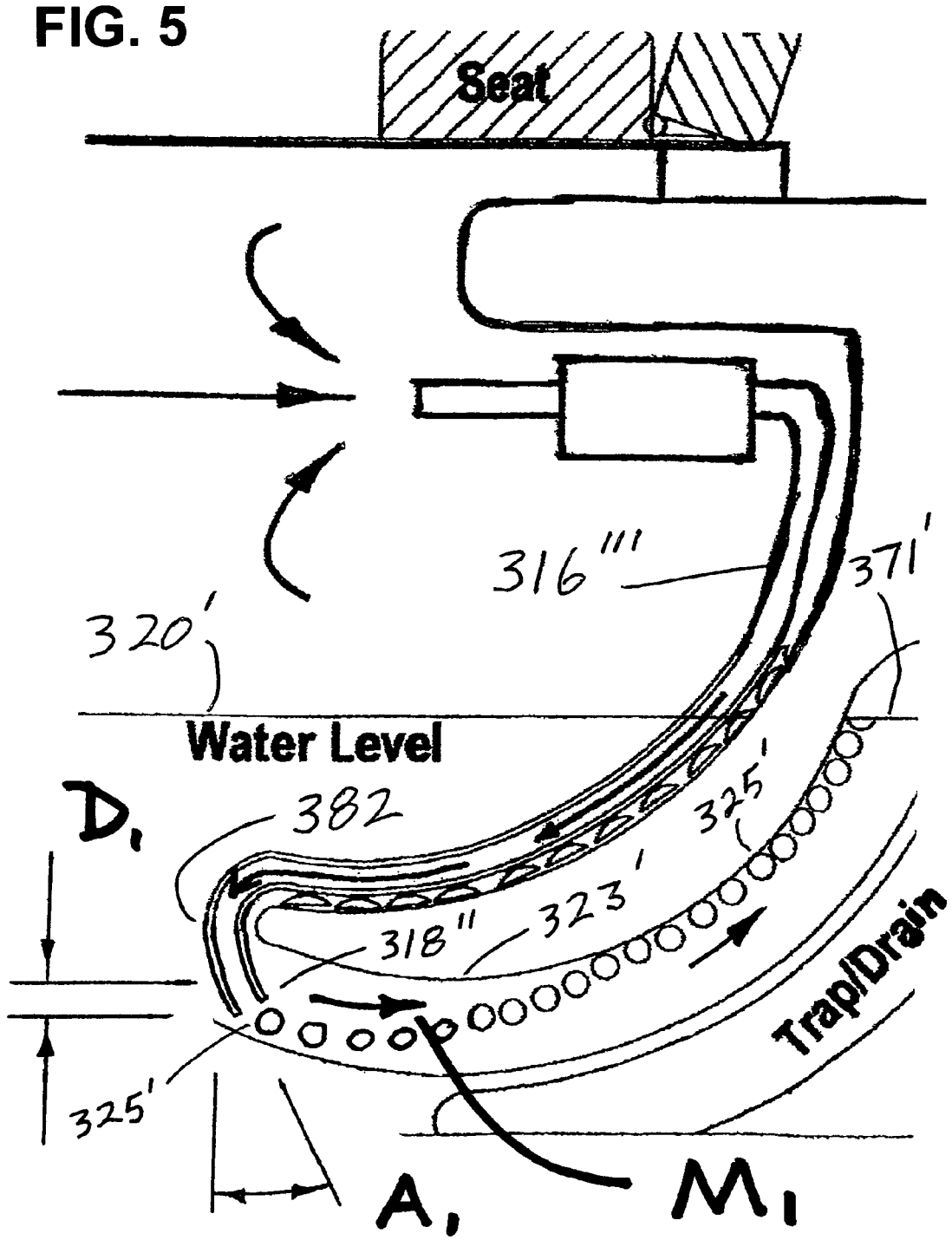
FIG. 5 is a partly-sectional side view of the present invention as-installed, according to yet another embodiment.

Referring to FIG. 5, in another embodiment the outlet 318" of the exhaust tube is below the portion of the drain ceiling 323' furthest below the normal standing water level of the toilet bowl by a distance $D_1$. The distance $D_1$ is not critical, but rather is used to illustrate that the invention can also be effective when the outlet is located below portion 323'. If air bubbles 325' exited exhaust tube 316'" with no substantial exit velocity then it is possible they would rise to the surface of the water 320' in the toilet bowl, instead of surface 371' of the water in the drain.

This would cause the odor-containing air to be returned to the interior of the toilet bowl. However, in this embodiment the outlet is oriented so as to direct the flow of air into the drain, taking advantage of the fact that an exit velocity is imparted to the air bubbles as they are formed at the outlet. Therefore the outlet can be located at a distance $D_1$ with the design consideration that the air bubbles will be transported through the water in a direction that will cause them to "clear" portion 323' before then rising to surface 371' as desired, due to their inherent buoyancy. Outlet bend 382 located toward outlet 318 is responsible in part for causing the air bubbles to be transported in a predetermined direction $M_1$. Outlet bend 382 to creates angle $A_1$ substantially within the plane of symmetry described above, so that the flow of odor-containing air is not just downward (i.e. perpendicular with respect to the plane of the floor). $A_1$ includes angles in a range from about 5 degrees to about 160 degrees.

Referring to FIGS. 1-12, an electric power source comprises a battery or plurality of batteries 375 or 30, respectively. The specifications for the batteries are generally that it can operate the electric motor of the fan assembly described above for extended periods of time before needing to be replaced. The battery or batteries can supply a total voltage of about 3 to about 12 volts DC to at least one of the electrical components. Alternatively, a total voltage of about 2 to about 14 volts DC can be supplied. Alternatively, a total voltage of about 1 to about 24 volts DC can be supplied. The batteries energize the electric motor under predetermined conditions such as, for example, the predetermined conditions described above. The battery may be of a dry cell variety, either alkaline or nonalkaline. Furthermore, the battery may be of the rechargeable variety. Furthermore, the battery may be made of other materials capable of longer life and/or smaller size than an alkaline dry cell battery, such as lithium or lithium polymer. An electric light operated by the battery can be affixed to the battery, either permanently or nonpermanently. This light can serve multiple functions such as, for example, an indicator of the battery condition, as when a brighter light output or different color light output is used to indicate a battery in good condition for operating the electric motor. Furthermore, the light can become illuminated to indicate that the fan is in operation. This may serve as a visual reminder to the user to turn the electric motor off via the manual electric switch. Furthermore, the light can be of a wattage and construction to serve as a "night light" in a room where the recharging of the battery occurs. (The term "night light" refers to any light used to illuminate an area, regardless of the time of day.) For example, in the event that a battery recharger is integrated with the battery and light, this integrated assembly can be plugged into a bathroom electrical outlet to perform the function of a night light at the same time in which the battery is being recharged for later use in operating the electric motor. The electric motor can alternatively be energized by electricity supplied from an electric cord connected to a wall outlet, presuming that the motor and other electric components have been selected appropriately for use with the voltage and current supplied at the wall outlet. Or, alternatively, that the electricity at the wall outlet has been converted using an appropriate electric power converter or power supply which converts alternating current (AC) into direct current (DC) of the proper voltage level for operating the motor.

Referring to FIGS. 1-12, in other embodiments the invention further comprises means for accessing the scented element, further wherein the means for accessing the element are part of the auxiliary housing or combination housing. It is understood that the scented element for use as an air freshener in conjunction with the toilet ventilation device will eventually become ineffective as its volatile chemical components evaporate with use and the passage of time. Therefore it will be necessary to replace the scented element from time to time. The means for accessing the scented element can include snap-fitting components, housing components secured by screws or bolts or latches, components that are threaded together with male and female threaded features, male and female "twist-and-lock" features, and so forth. The invention may also have means for retaining the scented element. The means for retaining include snap-fitting components, press-fitting components, screws, bolts, latches, threaded components that are threaded together with male and female threaded features, and so forth.

The time interval for changing the scented element' can be at the user's convenience. Alternatively, it can be suggested to the user by a visual indication such as the same light described above for the battery beginning to flash after a predetermined condition. The predetermined condition may be based on the number of cycles of use of the toilet ventilation device, or the number of hours of operation of the electric motor, or other conditions. The necessary computer control logic to achieve these various functions is contained within the electronic circuitry of a circuit board 42 shown in FIG. 9.

Figure 9:
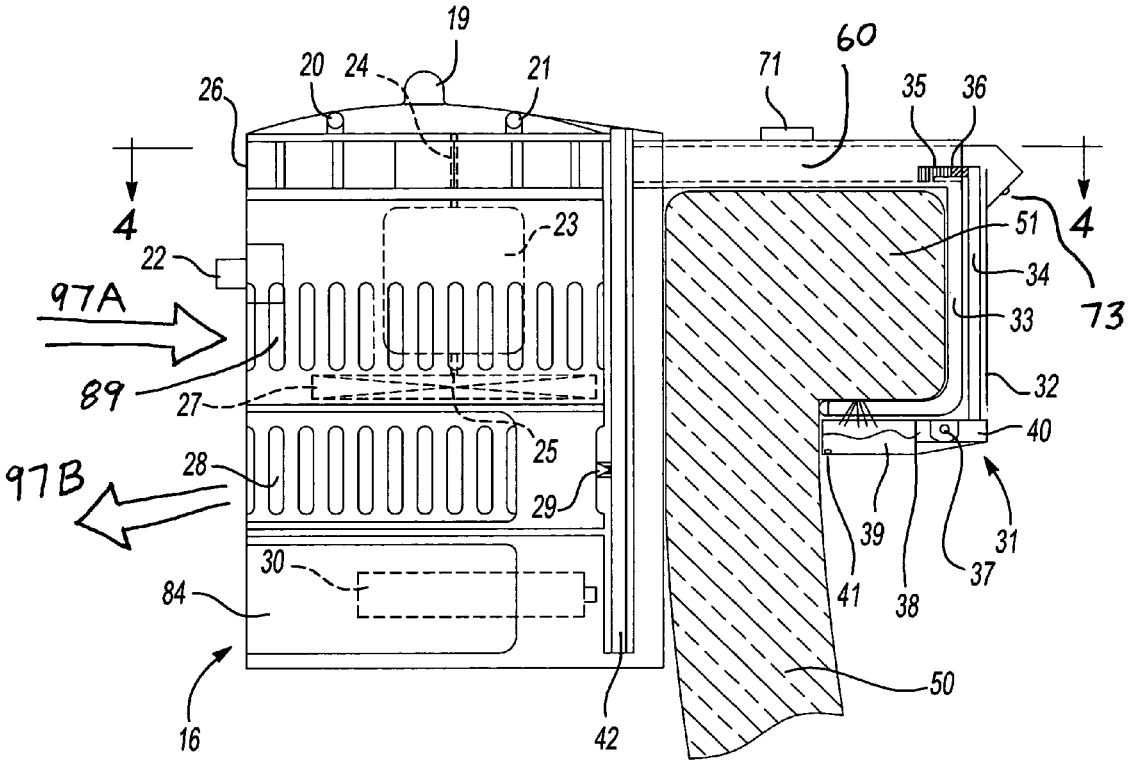
FIG. 9 is a partly-sectional side view of the main housing assembly for the embodiment of FIG. 7.

The following describes one sequence of operation for the electrical components:

1. A short-range infrared (IR) sensor (a.k.a. adjustable motion sensor or automatic sensor switch) detects a person on the seat.
2. The IR sensor activates the one minute (fully adjustable) timer to start blower motor or vane pump motor. Note: scent fan assembly (i.e. scent motor) is also activated at the same time. Note: the scent fan can have a dedicated motor, or be driven from the blower motor or vane pump drive of the main air blower assembly as shown in FIG. 9.
3. The retentive timer accumulates time as the device is used until the designated limit of minutes (or hours and minutes) used is completed. Note: this accumulated time can be set at 300 minutes although this can be adjusted by manufacturer for a different setting as needed to achieve the best application of scent or fragrance release. After time limit is achieved, the "change cartridge" light is activated.
4. The "change cartridge" light remains lit until the scent cartridge is removed and replaced. Alternatively, the "change cartridge" light blinks at a selected rate until the scent cartridge is removed and replaced. When the scent cartridge is removed and replaced the reset timer terminals make contact and the retentive timer is automatically reset to zero hours used.
5. When the one minute timer is timed out the blower motor/vane pump is turned off. Note: the one minute timer can be adjusted up or down (i.e. to increase or decrease the time elapsed before the air blower system is turned off) for person's preference manually. For example, this adjustment can be performed using a knob mounted on a rotary potentiometer which is connected electrically to the circuit board.
6. When the voltage falls below the low limit (set by manufacturer) the charge battery light activates and the blower motor/vane pump will not operate until the uncharged battery is replaced with a newly charged unit. Alternatively, when the voltage falls below the low limit the blower motor/vane pump continues to operate without a newly charged unit for a time.
7. A step down transformer is used to convert the standard 110 volts at the wall receptacle to the required reduced voltage of the battery pack. This step down transformer can be part of the rechargeable battery pack. Alternatively, it can be part of the battery recharging unit that plugs into the 110 volt wall receptacle.
8. When the rechargeable unit is charging, the battery functions as a night light for the room while in charge operation. The night light is operated on 110 volts by utilizing the person's wall receptacle. Alternatively, the night light is operated using electric power supplied from the battery pack. Note: this charging unit also has a "dark detection" sensor or switch (not shown) that keeps night light deactivated until the room lighting is dimmed to a degree that the night light requires activation.
9. An optional long-range infrared (IR) sensor (not shown) can be utilized to detect that a person is approaching and/or standing in front of a toilet. If utilized, the long-range IR sensor can be located in close proximity to the short-range IR sensor 5J. Both the short-range and the long-range sensors can be oriented in various positions, and also oriented independently of each other. For example, the short-range sensor can be oriented in a substantially vertical orientation (so as to be most sensitive to motion that is perpendicular to the ground). Furthermore, the long-range sensor can be oriented at an acute angle (with respect to the ground), approximately in the plane that bisects the toilet. In this orientation, the long-range sensor will be adaptable to sensing a user as they walk toward the toilet, which will in turn activate a night light (not shown) for the inner surface of the toilet bowl. (The term "night light" refers to any light used to illuminate an area, regardless of the time of day.) However, a number of other adequate orientations for both of these sensors are possible. The long-range sensor, when activated, turns on the night light that illuminates the inner surface of the toilet bowl to assist person in increased visibility. The lid and/or toilet seat can be left in the "up" position to permit the sensor to sense a person approaching the toilet when they substantially reach a selected distance, so as to then activate the night light. Alternatively, when the lid and/or toilet seat is left in the "down" position, the long-range sensor can be used to activate the night light when it senses that the lid and/or toilet seat has been lifted "up" by a user. The night light feature can be turned on or off to reserve battery life at the person's preference by a toggle switch/slide switch on the unit itself. Switch operation is further described below. Alternatively, the night light feature can be used in combination with a "dark detection" sensor (not shown) similar to the one described above, in order to not activate the night light if a selected amount of light is present in the room. Alternatively, the night light can "time out" and turn off automatically when a selected amount of time has elapsed after it is activated.
10. The unit can be turned on or off with a toggle or slide switch at the person's choosing if the person does not wish to utilize the device. Switch operation is further described below.
11. The logic of the device is programmed by a programmable data storage chip (set by manufacturer) by using a PIC chip (Programmable Integrated Chip) or EPROM chip (Erasable Programmable Read-Only Memory chip). Either chip can be flashed or programmed by the manufacturer to required specifications. One possible PIC chip that may be adaptable for this application is the Model PIC12C508A-04/P PIC Microcontroller commercially available from Microchip Technology Inc., Chandler, Ariz.

12. An optional first tilt switch can also be used for example, on the bottom of the toilet seat to deactivate the blower motor/vane pump switch. This tilt switch turns off the blower motor or vane pump motor if the toilet seat is lifted to a substantially vertical position. One possible switch that may be adaptable for this application is a mercury/glass tilt switch, SPST, Item No. SW-04, commercially available from Images SI, Inc., Staten Island, N.Y.

The following describes the sequence of operation of a three-position switch for the sensor system:

1. The blower system has a three-position switch on the top of the unit.
2. The first switch position is "off" (system will not activate at all).
3. The second switch position of the three-position switch is used for close proximity range with a short-range sensor (first sensor).
4. Note: System will only activate blower system when person sits on toilet seat, not when in standing position.
5. The third switch position is set to detect the person standing in front of the toilet. The second sensor has a longer proximity range and is activated in the third switch position. This sensor, when activated, turns on a night light on the inside of the toilet bowl to assist person in visual assistance to allow person to see into the bowl in the dark. The third position of switch also activates the blower system when the person sits on the toilet seat, but not when standing.
6. Note: Third switch position will not activate if there is sufficient light to eliminate the need for bowl lighting. The second and third switch positions on the unit activate the blower system until the variable range timer times out and deactivates the blower system.
7. The purpose of the three-position switch is to allow the person various to options to customize the unit for different functions, as well as increasing the battery life before recharging.

Figure 7:
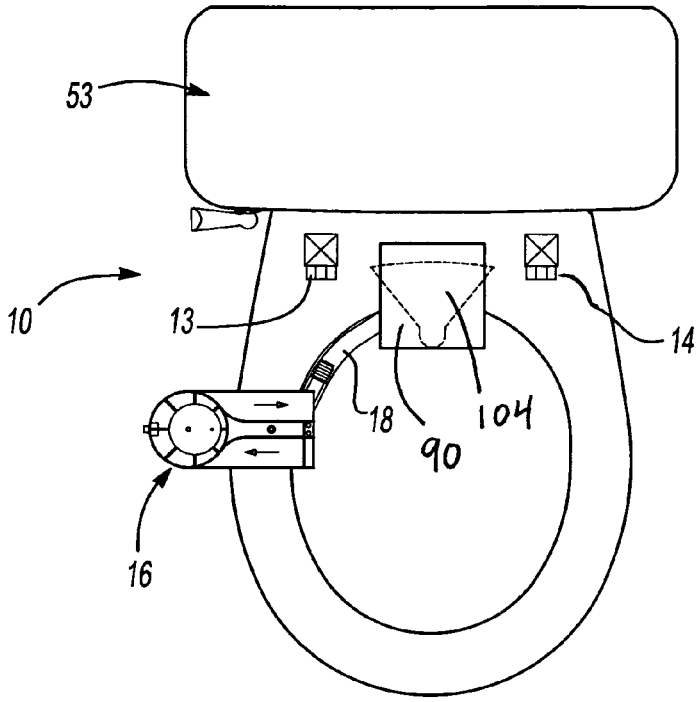
FIG. 7 is a top view of yet another embodiment of the present invention as-installed, with the toilet seat and lid removed for clarity.
Figure 8:
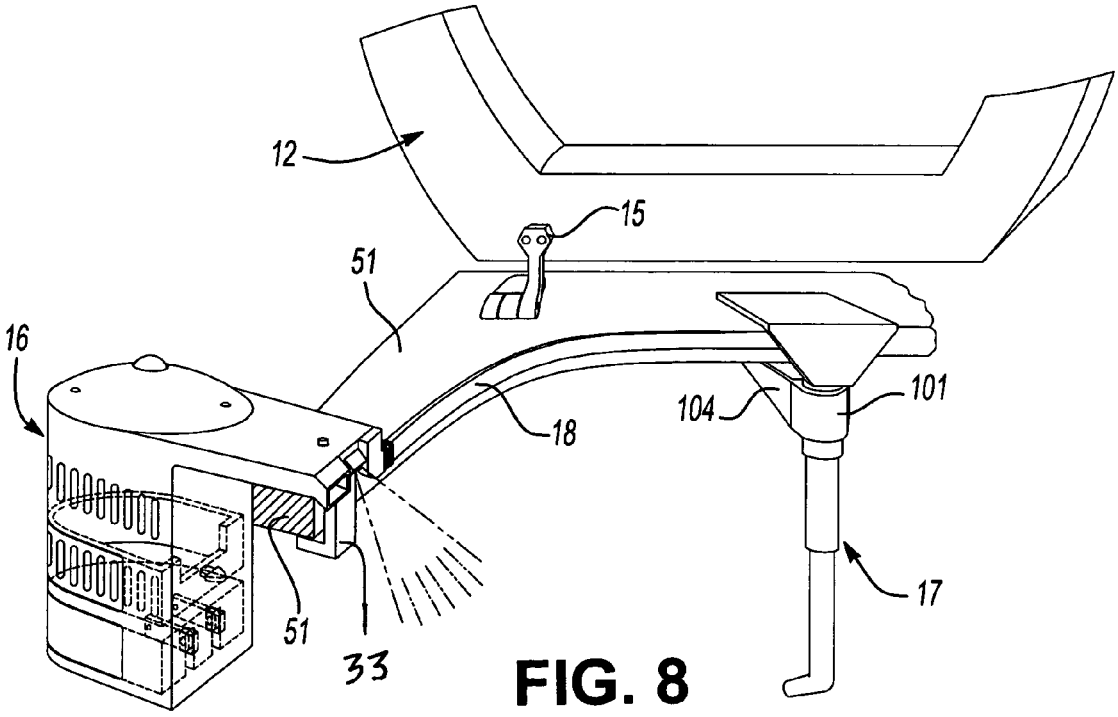
FIG. 8 is an isometric view of the embodiment of FIG. 7, with the toilet seat in the raised position.

Another embodiment of the present invention is shown in FIGS. 7-20. Referring to FIGS. 7-8, FIG. 7 is a top view of a toilet 10 with toilet seat 12 and lid (not shown) removed for clarity, so as to better see the main housing assembly 16 as-installed on toilet bowl rim 51. First and second hinges 13, 14 connect the toilet seat and lid to toilet 10 via seat attachment brackets (one of which is shown at 15). Toilet 10 has a toilet water tank 53 which is located towards the rear of the toilet as a person faces it.

FIG. 8 is an isometric view of the embodiment of FIG. 7, with the toilet seat in the raised position. Referring to FIG. 8, an exhaust tube assembly 17 is fastened to rim 51 via mounting bracket 90. Connecting channel 18 runs underneath rim 51 or alongside it, to provide fluid communication between the main housing assembly and the exhaust tube assembly.

FIG. 9 is a partly-sectional side view of main housing assembly 16 for the embodiment of FIG. 7. The main housing assembly is mounted on the left side of toilet bowl rim 51, as a person faces the toilet. Note that the present invention also contemplates mounting the main housing assembly on the right side, by making the geometric features of first inlet end 61 and second outlet end 66 readily interchangeable, and providing a switch to reverse the direction of rotation for electric motor 23. Mounting the main housing assembly is accomplished via main housing assembly mount 32, which fits over rim 51, and is of sufficient strength to support the weight of all subcomponents in the main housing assembly. These subcomponents include an air pump assembly 26, which can be a sliding vane pump as shown with a longitudinal axis of rotation (not shown) offset from a longitudinal axis passing through manual operation switch 19. Furthermore, the air pump assembly can be comprised of a centrifugal fan (not shown) having straight fan blades, in which case the driveshaft of the centrifugal fan can be aligned with the longitudinal axis passing through the manual operation switch. Furthermore, the air pump assembly can be comprised of a vortex fan (not shown) having curved fan blades, and a driveshaft similarly aligned with the above-described longitudinal axis. Air pump assembly 26 is driven by a driveshaft at first end 24 of electric motor 23. Furthermore, the electric motor has a driveshaft at second end 25 which is connected to a fan 27. This fan draws air from the region into the main housing assembly through a first plurality of louvers 89. Refer to the air flow path at 97A. The air then passes through an air freshener element 81 inside air freshener cartridge 28 and exits the main housing assembly via a second plurality of louvers 82. Refer to the air flow path at 97B. In this way, the toilet ventilation device serves to deodorize the air within the region. Electric motor 23 is connected by an electrical circuit with circuit board 42. The circuit board contains the electrical components needed to perform all aspects of logic and control required by the toilet ventilation device and described herein. The circuit board is connected by an electrical circuit to battery or batteries 30 such as those described above. The battery or batteries provided the source of electrical power needed for the circuit board and electric motor. Alternatively, the source of electric power can be an electric wall outlet 87 with an electrical cord running from the electric wall outlet to circuit board 42. The voltage level supplied to the toilet ventilation device can be a level that is typically available in a household, such as 120 volts AC, or a level such as 24 volts DC or 9 volts DC that is supplied by an electrical transformer plugged into the wall outlet.

Figure 10:
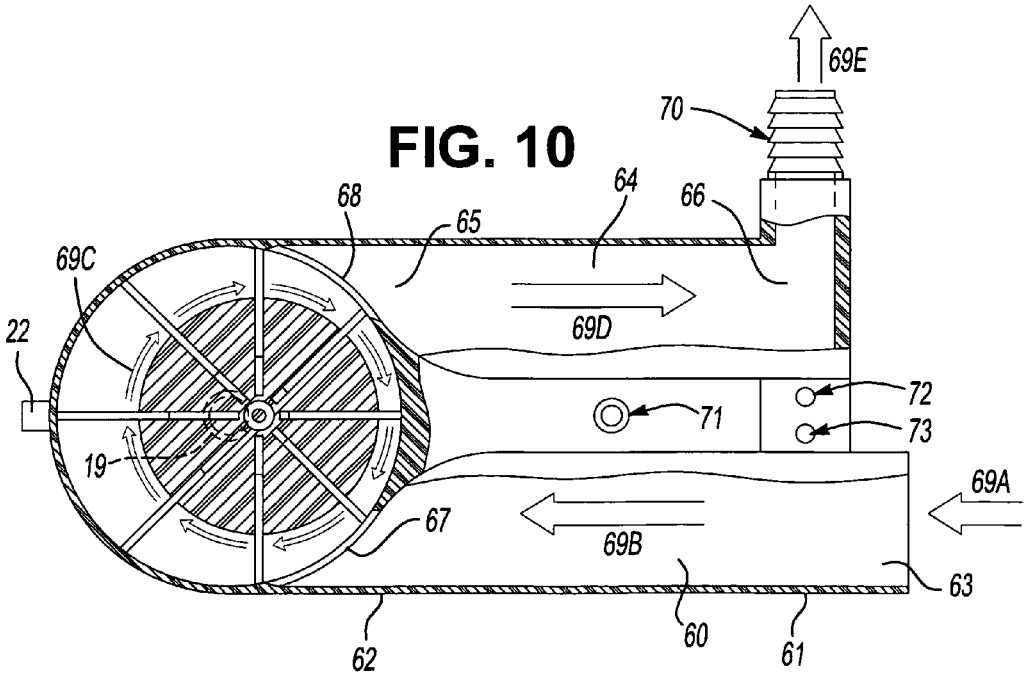
FIG. 10 is a partly-sectional top view of the main housing and air pump assemblies for the embodiment of FIG. 7.

FIG. 10 is a partly-sectional top view of the main housing and air pump assemblies for the embodiment of FIG. 7. In FIG. 10, the direction of rotation for the air pump assembly is clockwise, so as to create a low pressure region at air intake 67 and high pressure region at air exhaust 68. Other arrangements of the air pump assembly having other orientations or direction of rotation (for example, counterclockwise) are contemplated by the invention. Air inlet conduit 60 has first inlet end 61 and second inlet end 62. Second inlet end 62 is in fluid communication with air intake 67. First inlet end 61 has a air inlet port 63 which is open to and in fluid communication with the region (not shown) which the invention is intended to affect, including the interior airspace 301 of the bowl of toilet 10, including the airspace generally surrounding toilet 10. Air outlet conduit 64 has a first outlet end 65 and a second outlet end 66. First outlet end 65 is in fluid communication with air exhaust 68. Second outlet end 66 is in fluid communication with air outlet port and nipple 70. The low pressure region at air intake 67 and high pressure region at air exhaust 68, together with the air inlet and outlet conduits described above create a flow path for odor-containing air as shown by arrows 69A-69E.

The main housing assembly also includes first and second toilet bowl illumination lights 72, 73 as shown in FIGS. 9-10. These lights can be of various kinds and numbers—a design employing one light is contemplated by the invention. The lights may be light emitting diodes (LED's). As shown in FIGS. 8-9, the lights are pointed at a downward angle to illuminate the interior of the toilet bowl, permitting, for example, use of the toilet while standing up at night without turning on any room lights.

Figure 12:
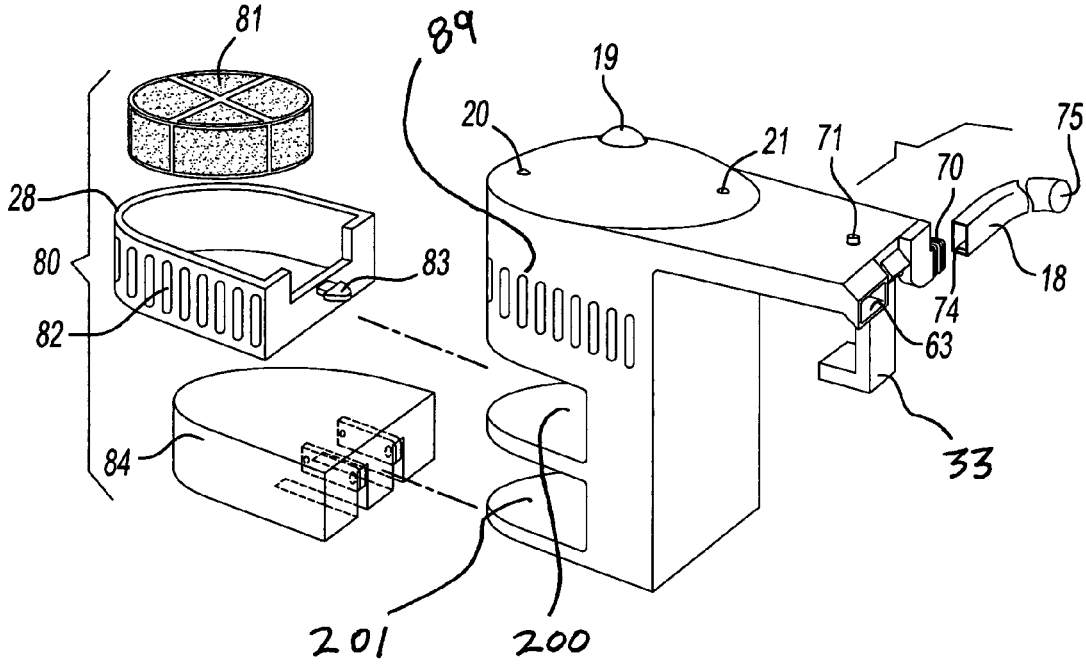
FIG. 12 is an exploded view of the main housing assembly for the embodiment of FIG. 7.
Figure 13:
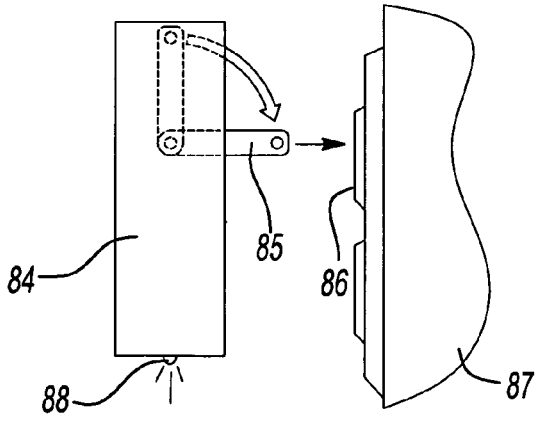
FIG. 13 is a side view of the battery pack for the embodiment of FIG. 7.

FIG. 12 is an exploded view of the main housing assembly for the embodiment of FIG. 7. Removable air freshener and battery pack assemblies 80 are comprised of air freshener cartridge 28 and battery pack 84. Air freshener element 81 is mounted inside the air freshener cartridge. The air freshener cartridge slides into the main housing assembly and is received by an upper compartment 200. The battery pack slides into the main housing assembly and is received by a lower compartment 201. The battery pack comprises battery pack terminals 85. These terminals fold into the body of the battery pack so as to permit the battery pack to slide into compartment 201. The terminals also rotate 90 degrees as shown in FIG. 13 to permit insertion of the terminals into electric wall outlet receptacle 86 of electric wall outlet 87, for the purpose of recharging the battery or batteries, if rechargeable batteries are employed. Battery pack 84 can also include a night light 88. The night light can also include an ambient light sensor or "photo eye" to turn the night light on only during conditions of low ambient light, for example at night. The night light operates during the time the battery pack is plugged into receptacle 86 or, in addition, during the time when the battery pack is received into compartment 201.

Figures 14, 15:
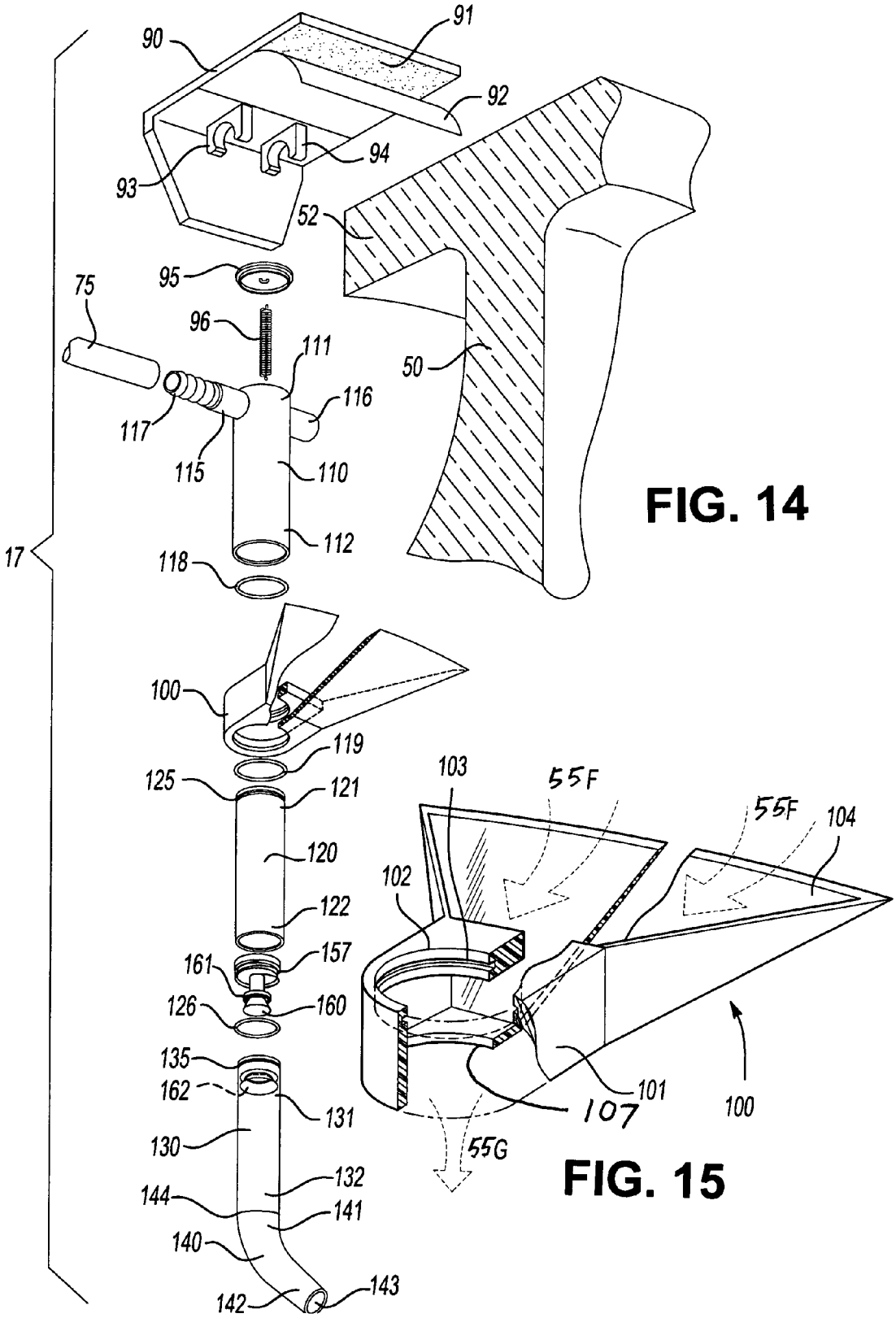
FIG. 14 is an exploded view of the exhaust tube assembly for the embodiment of FIG. 7.
FIG. 15 is an isometric view of the funnel assembly for the embodiment of FIG. 7.

FIG. 14 is an exploded view of the exhaust tube assembly for the embodiment of FIG. 7. Exhaust tube assembly 17 comprises mounting bracket 90, upper exhaust tube 110, intermediate exhaust tube 120, lower exhaust tube 130, outlet pipe 140 and funnel assembly 100. Exhaust tubes 110, 120, 130 are oriented substantially perpendicular with respect to the plane of the floor. The exhaust tubes can be formed from a wide variety of polymers, plastics, rubbers, silicones, nylons, and sheet metals, including those that are substantially flexible and substantially inflexible. Upper exhaust tube 110 has first and second ends 111, 112, respectively. Intermediate exhaust tube 120 has a first and second ends 121, 122, respectively. Lower exhaust tube 130 has first and second ends 131, 132, respectively. First and second trunnions 115, 116 are located at first end 111, being in-line with one another and perpendicular to the upper exhaust tube. Trunnion 115 is hollow so as to permit fluid communication between outlet end 75 and first end 111. Trunnion 115 provides an inlet 117 for fluid communication of odor-containing air from connecting channel 18 into exhaust tube assembly 17.

In another embodiment (not shown), two exhaust tubes are utilized, as upper and lower exhaust tubes. For this embodiment, the essential operation of the toilet ventilation device remains the same while using one less exhaust tube.

In another embodiment (not shown), the upper, intermediate and lower exhaust tubes, are integrated into a tube configuration that does not extend or retract with the operation of the electric motor, but rather remains substantially in a selected position. For this embodiment, the location of outlet 143 does not substantially change.

Intermediate exhaust tube 120 is nested within the upper exhaust tube. Lower exhaust tube 130 is nested within the intermediate exhaust tube. The upper, intermediate and lower exhaust tubes form a telescoping exhaust tube assembly which can be extended and retracted upon operation of the toilet ventilation device, as further described below. The exhaust tubes are substantially in sliding and fluid communication with each other as the exhaust tube assembly reaches and achieves its fully extended position shown in FIG. 16, though some odor-containing air can pass through the interfaces of the exhaust tubes and back into the interior airspace 301. A substantially half-round projection 125 can be integrally molded or formed at first end 121 of the intermediate exhaust tube. A substantially half-round projection 135 can be integrally molded or formed at first end 131 of the lower exhaust tube. Projections 125 and 135 serve to prevent the exhaust tubes from extending to the point that their telescoping design becomes disassembled. A first wiper 119 is located within the upper exhaust tube at second end 112. The first wiper performs two functions. It provides a sealing function to restrict odor-containing air from passing back into the interior airspace 301. It also provides a scraping function, to clean the intermediate exhaust tube of any unwanted materials as the intermediate exhaust tube retracts into the upper exhaust tube due to the force applied by return spring 96. These unwanted materials may include solid waste and toilet paper. A second wiper 126 is located within the intermediate exhaust tube at its second end 122, and performs the same two functions.

The lower exhaust tube contains a check valve assembly 150, which will be described further below. After the exhaust tubes have been assembled, outlet pipe 140 may be attached to the lower exhaust tube at joint 144. The outlet pipe may be attached by any of various mechanisms, including mating snap-fitting features in the lower exhaust tube and outlet pipe, use of a durable adhesive, etc. Outlet pipe 140 has first and second ends 141, 142, with an outlet 143 for odor-containing air located at second end 142. Outlet 143 comprises the outlet for exhaust tube assembly 17. Outlet 143 substantially faces the water seal-type drain at least part of the time the air pump assembly operates.

Figure 19:
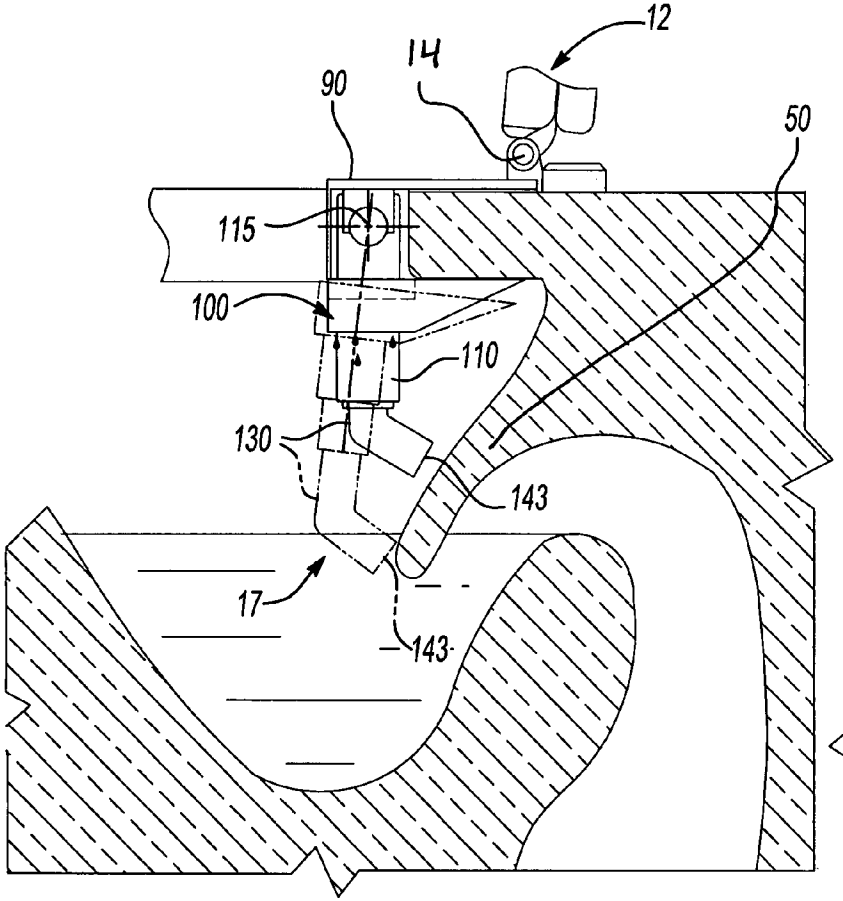
FIG. 19 is a diagrammatic representation of the embodiment of FIG. 7, with the exhaust tube assembly in a retracted position as seen from a side of the toilet.

FIG. 15 is an isometric view of a funnel assembly 100 for the embodiment of FIG. 7. The funnel assembly includes a funnel assembly boss 101 having a first aperture 102, groove 103 and a second aperture 107. First end 111 of the upper exhaust tube fits into the first aperture and is slidingly retained therein by O-ring 118 located in groove 103. With the funnel assembly so-installed on the upper exhaust tube, funnel 104 is oriented as shown in FIG. 19 so as to direct some of the water from a water rinse port (not shown) to the interior of boss 101, past the second aperture and then down the exhaust tubes. In this fashion, a mechanism is provided to help clean the exhaust tubes of any unwanted materials that may have become adhered to them when the toilet is used.

Figure 16:
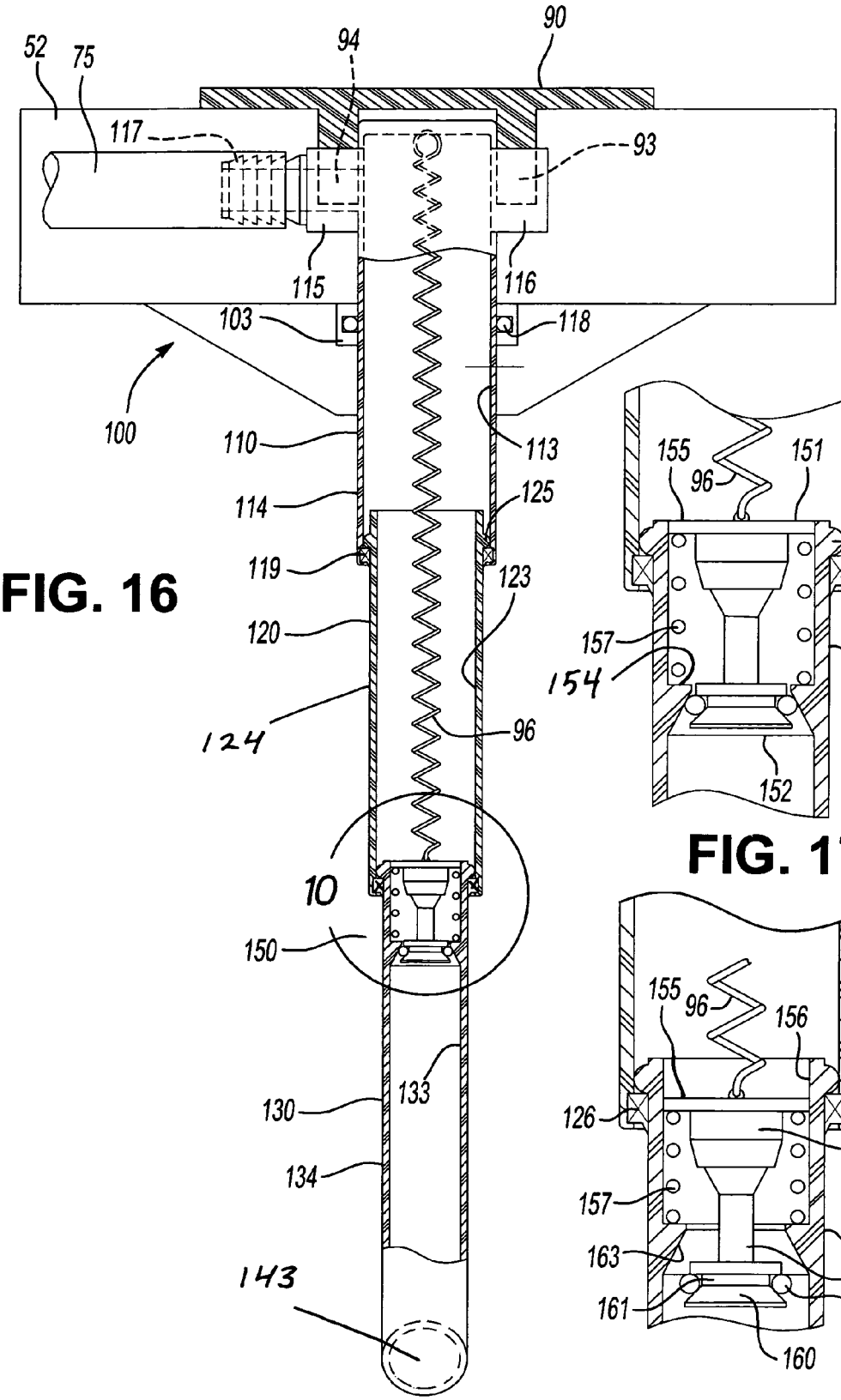
FIG. 16 is a partly-sectional front view of the exhaust tube assembly for the embodiment of FIG. 7.
Figure 17:
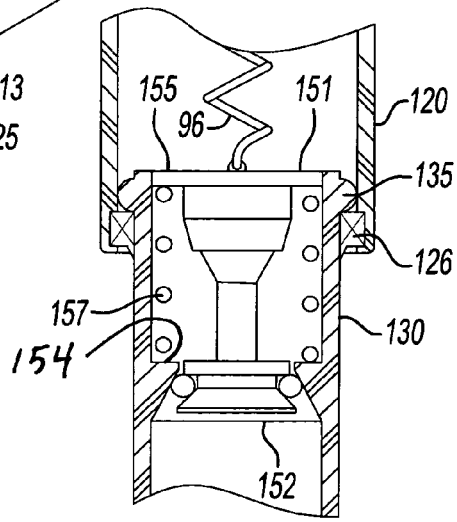
FIG. 17 is a partly-sectional front view of the check valve assembly for the embodiment of FIG. 7, showing the check valve in a first position.
Figure 18:
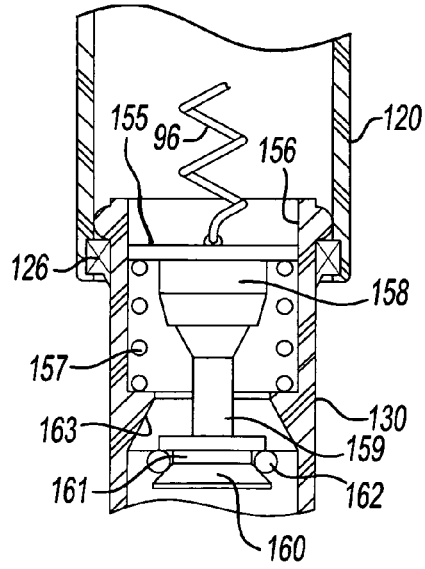
FIG. 18 is a partly-sectional front view of the check valve assembly for the embodiment of FIG. 7, showing the check valve in a second position.

FIG. 16 is a partly-sectional front view of exhaust tube assembly 17 for the embodiment of FIG. 7. This is the view seen from looking at the exhaust tube assembly from inside the toile bowl in the direction of the water tank. The exhaust tube assembly is shown substantially in its fully extended position. This position is achieved due to the air pressure exerted within the exhaust tubes and on the check valve assembly 150 when the toilet ventilation device is operated. This exhaust tube assembly position is caused when the air pressure within the exhaust tubes reaches a first selected value, which extends the exhaust tubes but does not permit odor-containing air to flow past the check valve and exit the outlet 143. Check valve assembly 150 contains inlet and outlet ends 151, 152. Return spring 96 is connected to inlet end 151 of check valve inlet member 155. Check valve outlet end 152 comprises check valve 160 having a groove 161 which contains O-ring 162. O-ring 162 comes in contact with check valve seat 163 when the check valve assembly is in a first position of FIG. 17. Helical spring 157 is located inside the check valve assembly between inlet member 155 and shelf 154. FIG. 18 is a partly-sectional front view of the check valve assembly for the embodiment of FIG. 7, showing the check valve in a second position. This second position is caused when the air pressure within the exhaust tubes reaching a second selected value, which keeps the exhaust tubes extended and also permits odor-containing air to flow past the check valve and exit the outlet 143. One possible check valve that may be adaptable for this application is the Model 170 cartridge check valve commercially available from Smart Products, Inc., Morgan Hill, Calif.

Figure 20:
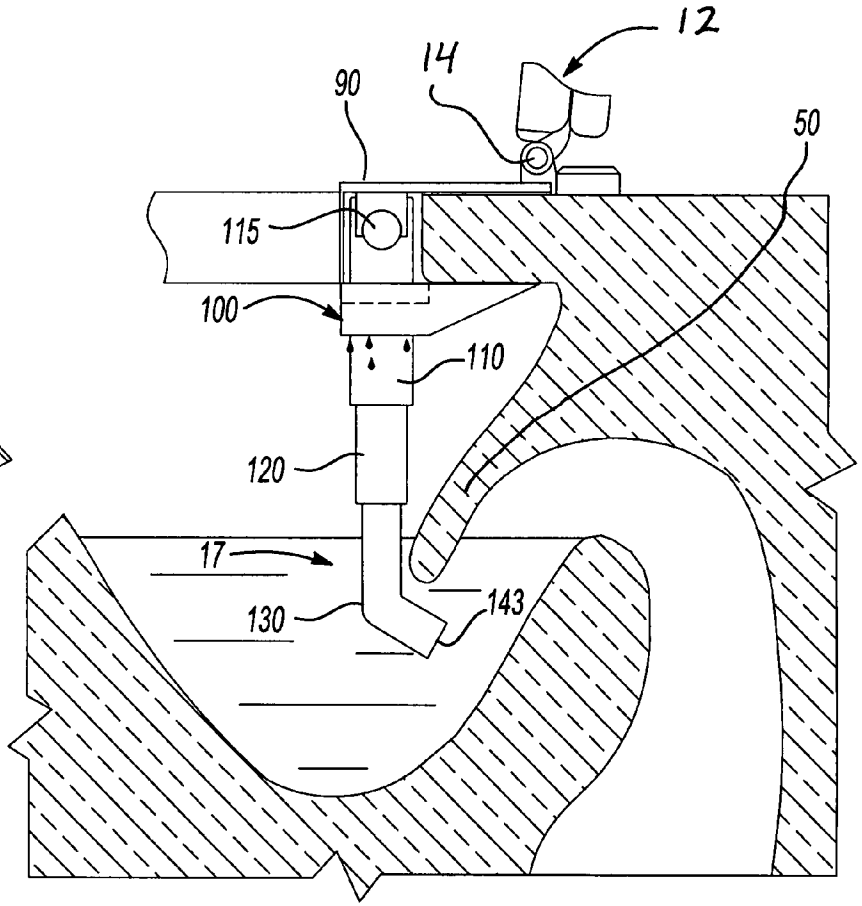
FIG. 20 is a diagrammatic representation of the embodiment of FIG. 7, with the exhaust tube assembly in an extended position as seen from a side of the toilet.

FIG. 19 is a diagrammatic representation of the embodiment of FIG. 7, with exhaust tube assembly 17 in a retracted position as seen from a side of the toilet, and also showing in phantom lines the exhaust tubes in a partly extended position. As the exhaust tubes extend, the outlet 143 may come into contact with toilet bowl wall 50. This is affected by the specific geometries of the toilet ventilation device and respective toilet, and in particular by the geometry of portion 52 of the toilet bowl shelf which seat 12 attaches to. If portion 52 has a relatively small amount of "overhang," then such contact is more likely. To address this contact and permit proper operation, exhaust tube assembly 17 can pivot substantially freely on first and second trunnions 115, 116 within first and second trunnion journals 93, 94. In this fashion, the toilet ventilation device is not damaged when it extends and proper operation is permitted. Note that the force created by the displaced center of gravity for the assembly will tend to cause the assembly to follow the contour of toilet bowl wall 50 as the exhaust tubes extend. This force will also tend to cause outlet 143 to move into the drain as the assembly repositions itself, as shown in FIG. 20. Alternatively, at least one torsion spring may be integrated into the upper exhaust tube 110 to provide additional restoring force to similarly cause the assembly to follow the contour of toilet bowl wall 50. Alternatively, at least one coil spring can be used for this purpose.

The present invention contemplates that various geometries for outlet 143 will assist in the proper extending and retracting of the outlet pipe so as not to become stuck at the front lip of the drain ceiling. Such geometries include various selected angles between the longitudinal axis (not shown) of the lower exhaust tube and the longitudinal axis (not shown) passing through the center of the outlet. One such selected range of angles is 15-75 degrees. Furthermore, outlet 143 may simply be formed on the appropriate side of the lower exhaust tube, thus eliminating outlet pipe 140 while still directing odor-containing air into the drain during operation.

The primary function of the toilet ventilation device is to displace the air/odor (approximately 4-12 cubic feet per minute, or up to 18 cubic feet per minute) within the toilet bowl to the other side of the trap or drain hole, into the sewer line. This process is accomplished by utilizing a blower/vane pump to create a is vacuum on the inlet line inside the bowl, and transferring the air along the rim, through the exhaust tube and beyond the drain hole, on any conventional toilet. Thus, eliminating any odors within the toilet region.

The toilet ventilation device operates on three different switch positions or modes (Off/Auto/Manual).

Off Mode

The toilet ventilation device will not allow any functions to operate.

Auto Mode

In the Auto Mode:

1. The person sits on the toilet seat and the start switch, i.e. toilet seat sensor 71, is activated. In one embodiment, about five pounds of force acting directly on the toilet seat sensor causes this sensor to generate an electric signal that will begin operation of the air pump assembly. In other words, the weight of the lid for the toilet seat will not cause the air pump assembly to operate. Other ranges of force to initiate operation are contemplated, including about four to about ten pounds, and about three to about twenty pounds.
2. The counter stores 1 count.
3. After a 2.0 second delay, the motor starts and the cycle timer begins timeout process.
4. The air flow pressure extends the exhaust tube to fully extended position.
5. The check valve opens to allow air to exhaust into the toilet drain
6. The cycle timer completes timeout. (ex. 30-45 seconds)
7. The motor turns off and the air flow stops.
8. The check valve closes.
9. The extension spring retracts exhaust tube out of the drain hole.
10. The system resets for the next cycle.

Manual Mode

In the Manual Mode:

1. The person sits on the toilet and manually presses the start button.
   Note: The start switch 71 will not activate the motor in manual mode.
2. The counter stores 1 count.
3. The motor starts and the cycle timer begins timeout process.
4. The air flow pressure extends the exhaust tube to fully extended position.
5. The check valve opens to allow air to exhaust into the toilet drain.
6. The cycle timer completes timeout (ex. 30-45 seconds).
7. The motor turns off and the air flow stops.
8. The check valve closes.
9. The extension spring retracts exhaust tube out of the drain hole.
10. The system resets for the next cycle.
    Note: If user depresses the start button while the system is operating the system will begin steps 07-10.

Bowl Light Operation

The bowl light operates in the following manner:

1. The person stands in front of the toilet seat and presses down on the toilet seat for less than 1.5 seconds, this activates the start switch 71 to turn on bowl light.
   Note: The motor will not start unless the start switch is depressed more than 2.0 seconds.
2. The bowl light illuminates and the cycle timer starts timeout (ex. 30 seconds).
3. Timer completes timeout and turns the light off.
4. The system resets for the next cycle.

Cycle Counter Operation

The cycle counter operates in the following manner:

1. Every time the motor starts, 1 count is added to the counter.
2. When the cycle count reaches the maximum limit of the cycle counter (factory set), the blue change freshener light 21 starts flashing.
3. The person must acknowledge flashing light 21 and remove the freshener.
4. When the expired air freshener is removed, circuit board contacts 29 are closed and the cycle counter is reset to start a new series of counts.
5. The person replaces the expired air freshener with a new unit. When a new unit is so installed in the main housing assembly, contacts breaker 83 attached to air freshener cartridge 28 forces the circuit board contacts open and keeps them in an open position. Therefore the cycle counter does not reset until the air freshener is again removed.

Second Tilt Switch Assembly Operation

Figure 11:
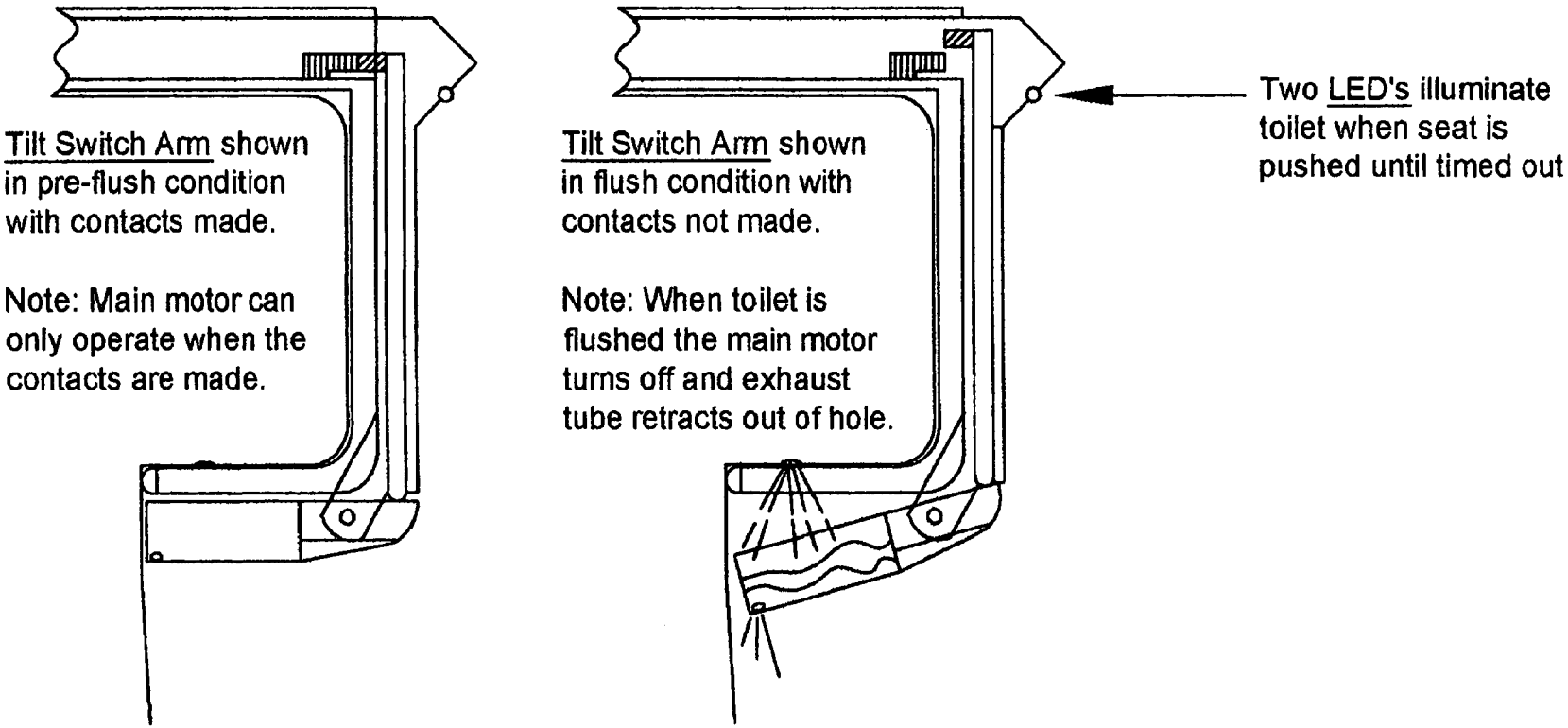
FIG. 11 is a side view of a second tilt switch assembly, as shown in FIG. 9, with the tilt switch contacts in two positions.

FIG. 11 is a side view of a second tilt switch assembly, as shown in FIG. 9, with the tilt switch contacts in two positions. Referring to FIG. 11, the second tilt switch assembly 31 operates in the following manner:

1. The toilet is flushed by the person.
2. The flush hole under the rim fills the tilt switch reservoir, i.e. tilt switch bucket 38, with water.
3. The tilt switch tilts and electrically breaks contacts 35, 36 which are connected to the circuit board.

The broken contacts turn off the motor.

4. The air flow stops.
5. The check valve closes.
6. The extension spring, i.e. return spring 96, retracts exhaust tube out of the drain hole.
7. The system resets for the next cycle.

Alternatively, a different tilt switch design may be connected to tilt switch bucket 38, such as, for example, the first tilt switch from Images SI, Inc., described above. The first tilt switch would be connected electrically with circuit board 42 and provide the same function of shutting off the electric motor after the toilet is flushed.

Rechargeable Battery Pack Operation

The Rechargeable Battery Pack operates in the following manner:

1. Red change battery light 20 flashes when the battery voltage drops below factory requirements.
2. The person slides the battery pack out of the main motor housing assembly.
3. The person rotates the male contacts 90 degrees and places the battery pack in any conventional wall outlet.
4. The rechargeable battery pack serves as a night light while in the charging process.
5. A photo eye sensor detects loss of light and activates the night light, when dark. The photo eye sensor also deactivates the night light when light increases.

Note: The night light will not function when placed back in main housing assembly.

6. When the rechargeable battery pack is charged, the person unplugs the pack from the wall outlet, rotates the male contacts 90 degrees back to circuit board position.
7. The person slides the rechargeable battery pack back into the main motor housing assembly.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

The invention claimed is:

1. A device for transporting odor-containing air from a region including an interior airspace of a toilet bowl to a drain line that connects a water seal-type drain of the toilet bowl to a septic system, comprising:

an air pump assembly having an air intake and an air exhaust, wherein the air intake is in fluid communication with the region;

an exhaust tube assembly including an inlet and an outlet, wherein the outlet is substantially between a surface of a water seal and a portion of a drain ceiling furthest below a normal standing water level of the toilet bowl to prevent drain line and septic system air from entering the outlet; and a connecting channel, wherein the connecting channel is in fluid communication with the air exhaust and the inlet;

wherein said air pump assembly has a positive displacement vane pump configured to create a low pressure region at the air intake and a high pressure region at the air exhaust to create a flow path for the odor-containing air and to overcome a head pressure exerted by water standing in a drain so that odor-containing air will be transported from the outlet into the drain line; and an air inlet conduit in fluid communication with the air intake;

said positive displacement vane pump having an axis of rotation offset from a longitudinal axis of the air pump assembly, the air intake comprising the air intake opening nearest the vanes of said positive displacement vane pump, wherein the axis of the air intake opening is within a plane substantially perpendicular to the axis of rotation.

2. The device of claim 1, further comprising an air outlet conduit in fluid communication with the air exhaust, further wherein the air inlet conduit and the air outlet conduit are substantially within the same plane and proximately located with respect to each other, further wherein the air inlet conduit and the air outlet conduit are substantially parallel with respect to each other.

3. The device of claim 2, further wherein the air inlet conduit and the air outlet conduit are separated by a distance.

4. The device of claim 2, the air inlet conduit having a height and a width, wherein the height is less than the width.

5. The device of claim 2, further wherein the air inlet conduit has an air inlet port having a height and a width, wherein the height is less than the width.

6. The device of claim 2, further comprising a main housing assembly, the main housing assembly having an air outlet port which is substantially perpendicular to the air outlet conduit.

7. The device of claim 2, further comprising a main housing assembly, the main housing assembly having a flow path for air exiting the main housing assembly which is substantially perpendicular to the air outlet conduit.

8. The device of claim 7, wherein the air inlet conduit and the air outlet conduit are integral with the main housing assembly.

9. The device of claim 2, further comprising a main housing assembly, wherein the air inlet conduit and the air outlet conduit are integral with the main housing assembly.

10. The device of claim 1, the device further comprising an illumination light for an inner surface of the toilet bowl, wherein the illumination light and air pump assembly are proximately located with respect to each other.

11. The device of claim 10, the device further comprising an infrared sensor, wherein the infrared sensor activates the illumination light under predetermined conditions.

12. The device of claim 10, wherein the illumination light and air pump assembly are proximately located with respect to each other when the illumination light illuminates the interior of the toilet bowl.

13. The device of claim 1, further comprising an air outlet conduit in fluid communication with the air exhaust, further wherein the air inlet conduit and the air outlet conduit are substantially within the same plane and proximately located with respect to each other.

14. The device of claim 1, wherein said positive displacement vane pump is configured to produce an airflow through the outlet of about three to about six cubic feet per minute.

15. The device of claim 1, further comprising an air freshener element, said positive displacement vane pump further comprising a driveshaft, wherein the driveshaft is connected to a fan, wherein the fan causes air to move from the region through the air freshener element during operation of the device.

16. The device of claim 1, further comprising an air outlet conduit in fluid communication with the air exhaust, further wherein the axis of rotation is substantially perpendicular to the air outlet conduit.

17. A device for transporting odor-containing air from a region including an interior airspace of a toilet bowl to a drain line that connects a water seal-type drain of the toilet bowl to a septic system, comprising:

an air pump assembly having an air intake and an air exhaust, wherein the air intake is in fluid communication with the region;

an exhaust tube assembly including an inlet and an outlet, wherein the outlet is substantially between a surface of a water seal and a portion of a drain ceiling furthest below a normal standing water level of the toilet bowl to prevent drain line and septic system air from entering the outlet;

a connecting channel, wherein the connecting channel is in fluid communication with the air exhaust and the inlet;

wherein said air pump assembly has a positive displacement vane pump configured to create a low pressure region at the air intake and a high pressure region at the air exhaust to create a flow path for the odor-containing air and to overcome a head pressure exerted by water standing in a drain so that odor-containing air will be transported from the outlet into the drain line; and an air freshener element, said positive displacement vane pump further comprising a driveshaft, wherein the driveshaft is connected to a fan, wherein the fan causes air to move from the region through the air freshener element during operation of the device.

18. A device for transporting odor-containing air from a region including an interior airspace of a toilet bowl to a drain line that connects a water seal-type drain of the toilet bowl to a septic system, comprising:

an air pump assembly having an air intake and an air exhaust, wherein the air intake is in fluid communication with the region;

an exhaust tube assembly including an inlet and an outlet, wherein the outlet is substantially between a surface of a water seal and a portion of a drain ceiling furthest below a normal standing water level of the toilet bowl to prevent drain line and septic system air from entering the outlet;

a connecting channel, wherein the connecting channel is in fluid communication with the air exhaust and the inlet;

wherein said air pump assembly has a positive displacement vane pump configured to create a low pressure region at the air intake and a high pressure region at the air exhaust to create a flow path for the odor-containing air and to overcome a head pressure exerted by water standing in a drain so that odor-containing air will be transported from the outlet into the drain fine; and means for determining a time interval for changing an air freshener element.

19. The device of claim 18, the air pump assembly further comprising a cartridge, wherein the cartridge at least partly contains the air freshener element, further wherein the cartridge has means for communicating with the means for determining a time interval for changing the air freshener element.

20. A device for transporting odor-containing air from a region including an interior airspace of a toilet bowl to a drain line that connects a water seal-type drain of the toilet bowl to a septic system, comprising:

an air pump assembly having an air intake and an air exhaust, wherein the air intake is in fluid communication with the region;

an exhaust tube assembly including an inlet and an outlet, wherein the outlet is substantially between a surface of a water seal and a portion of a drain ceiling furthest below a normal standing water level of the toilet bowl to prevent drain line and septic system air from entering the outlet; and a connecting channel, wherein the connecting channel is in fluid communication with the air exhaust and the inlet;

wherein said air pump assembly has a positive displacement vane pump configured to create a low pressure region at the air intake and a high pressure region at the air exhaust to create a flow path for the odor-containing air and to overcome a head pressure exerted by water standing in a drain so that odor-containing air will be transported from the outlet into the drain line;

said positive displacement vane pump having an axis of rotation offset from a longitudinal axis of the air pump assembly;

said positive displacement vane pump having a plurality of vanes, wherein the vanes are substantially flat;

wherein the plurality of vanes reciprocate with respect to the axis of rotation when the pump operates;

further comprising an air inlet conduit and an air outlet conduit, wherein the air inlet conduit is in fluid communication with the air intake, and the air outlet conduit is in fluid communication with the air exhaust, further wherein the air inlet conduit and the air outlet conduit are substantially within the same plane and proximately located with respect to each other;

further comprising an air freshener element, said positive displacement vane pump further comprising a driveshaft, wherein the driveshaft is connected to a fan, wherein the fan causes air to move from the region through the air freshener element during operation of the device;

further comprising means for determining a time interval for changing an air freshener element.

* * * * *